US012098516B2

(12) United States Patent
Onodera et al.

(10) Patent No.: US 12,098,516 B2
(45) Date of Patent: Sep. 24, 2024

(54) SHOVEL AND SYSTEM

(71) Applicant: SUMITOMO HEAVY INDUSTRIES, LTD., Tokyo (JP)

(72) Inventors: Masaru Onodera, Kanagawa (JP); Takumi Itoh, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 355 days.

(21) Appl. No.: 17/444,862

(22) Filed: Aug. 11, 2021

(65) Prior Publication Data

US 2021/0372079 A1 Dec. 2, 2021

Related U.S. Application Data

(63) Continuation of application No. PCT/JP2020/005640, filed on Feb. 13, 2020.

(30) Foreign Application Priority Data

Feb. 15, 2019 (JP) ..... 2019-025396

(51) Int. Cl.
*E02F 3/36* (2006.01)
*E02F 3/43* (2006.01)
*E02F 3/32* (2006.01)

(52) U.S. Cl.
CPC ..... *E02F 3/437* (2013.01); *E02F 3/3677* (2013.01); *E02F 3/439* (2013.01); *E02F 3/32* (2013.01)

(58) Field of Classification Search
CPC ..... B60L 53/66; B60L 53/12; B60L 58/12; B60L 53/65; B60L 2270/40; B60L 53/60; B60L 3/0046; B60L 53/665; G07C 5/0808; G07C 5/008; Y02T 90/16; Y02T 10/70; Y02T 10/7072; Y02T 90/12; Y02T 90/14; Y02T 90/167; Y02T 90/10; Y04S 30/14; G05B 23/0262; G05B 2219/24065; G01S 1/04; H02J 50/10; B60Y 2200/91
See application file for complete search history.

(56) References Cited

U.S. PATENT DOCUMENTS 4,037,337 A * 7/1977 Hemphill ..... E02F 9/2825 37/444
4,123,861 A * 11/1978 Hemphill ..... E02F 9/2825 D15/32

(Continued)

FOREIGN PATENT DOCUMENTS

CN 208136981 U * 11/2018
DE 69737449 T2 * 11/2007 ..... B62D 55/244

(Continued)

OTHER PUBLICATIONS

Yukio et al., JP3061529B.translate.English, Hydraulic Drive Gear of Hydraulic Shovel Equipped With Loaderfront, Hitachi Constr Mach Co Ltd. (Year: 2000).*

(Continued)

*Primary Examiner* — B M M Hannan
(74) *Attorney, Agent, or Firm* — IPUSA, PLLC

(57) ABSTRACT

A shovel includes a lower traveling body, an upper turning body turnably mounted on the lower traveling body, a link unit attached to the upper turning body, and a processing circuitry configured to align an end of the link unit with an end attachment to be attached.

5 Claims, 10 Drawing Sheets

(56) References Cited

U.S. PATENT DOCUMENTS

| | | | | | |
|---|---|---|---|---|---|
| 4,200,423 | A * | 4/1980 | Sornsin | E02F 3/962 | 37/903 |
| 4,871,292 | A * | 10/1989 | Milanowski | E02F 3/3668 | 403/3 |
| 5,179,794 | A * | 1/1993 | Ballinger | E02F 3/3672 | 37/468 |
| 5,678,332 | A * | 10/1997 | Hawkins | E02F 3/965 | 414/722 |
| 6,076,029 | A * | 6/2000 | Watanabe | E02F 3/437 | 37/340 |
| 6,088,938 | A * | 7/2000 | Logan | E02F 3/8152 | 37/468 |
| 6,336,077 | B1 * | 1/2002 | Boucher | E02F 3/435 | 702/33 |
| 7,621,689 | B2 * | 11/2009 | Nishioka | E02F 3/3622 | 403/321 |
| 10,184,224 | B2 | 1/2019 | Ito et al. | | |
| 10,538,897 | B2 | 1/2020 | Uetake et al. | | |
| 2003/0226291 | A1 * | 12/2003 | Naruse | E02F 9/2221 | 37/348 |
| 2005/0102866 | A1 * | 5/2005 | Sewell | E02F 9/166 | 37/411 |
| 2006/0230752 | A1 * | 10/2006 | Sawada | E02F 9/2285 | 60/431 |
| 2009/0071667 | A1 | 3/2009 | Cox et al. | | |
| 2009/0282710 | A1 * | 11/2009 | Johnson | E02F 3/404 | 37/444 |
| 2011/0257816 | A1 * | 10/2011 | Song | E02F 9/2008 | 701/2 |
| 2012/0158234 | A1 * | 6/2012 | Choi | E02F 3/404 | 701/23 |
| 2013/0074377 | A1 * | 3/2013 | Colbert | E02F 9/085 | 280/765.1 |
| 2015/0240446 | A1 * | 8/2015 | Takaura | E02F 9/2292 | 137/636.1 |
| 2016/0060843 | A1 * | 3/2016 | Trotnow | B66C 13/04 | 29/401.1 |
| 2016/0251823 | A1 * | 9/2016 | Paull | E02F 9/265 | 701/50 |
| 2016/0258135 | A1 * | 9/2016 | Shimano | E02F 9/262 | |
| 2017/0107687 | A1 | 4/2017 | Ito et al. | | |
| 2017/0247860 | A1 * | 8/2017 | Lehtinen | E02F 9/2029 | |
| 2017/0298591 | A1 * | 10/2017 | Imaizumi | E02F 9/2296 | |
| 2018/0002899 | A1 * | 1/2018 | Morimoto | E02F 3/43 | |
| 2018/0079404 | A1 * | 3/2018 | Kaneko | B60W 20/00 | |
| 2019/0194903 | A1 * | 6/2019 | Nadaoka | E02F 3/34 | |
| 2019/0226175 | A1 * | 7/2019 | Mairet | E02F 3/422 | |
| 2021/0079625 | A1 * | 3/2021 | Narikawa | E02F 9/261 | |

FOREIGN PATENT DOCUMENTS

| | | | | |
|---|---|---|---|---|
| EP | 2725149 | | 4/2014 | |
| EP | 3363955 | | 8/2018 | |
| EP | 3779071 | | 2/2021 | |
| JP | H03-295935 | | 12/1991 | |
| JP | H1134719 | A * | 2/1999 | |
| JP | H11247220 | A * | 9/1999 | |
| JP | 3061529 | B2 * | 7/2000 | |
| JP | 2004162275 | A * | 6/2004 | |
| JP | 2004238874 | A * | 8/2004 | |
| JP | 2005061024 | A * | 3/2005 | |
| JP | 2006214236 | A * | 8/2006 | |
| JP | 3833163 | B2 * | 10/2006 | |
| JP | 2016-008477 | | 1/2016 | |
| JP | 2016-130409 | | 7/2016 | |
| JP | 2017-082472 | | 5/2017 | |
| JP | 2018128422 | A * | 8/2018 | |
| JP | 2018168640 | A * | 11/2018 | |
| WO | 93/01366 | | 1/1993 | |
| WO | 2013/034516 | | 3/2013 | |
| WO | WO-2014051170 | A1 * | 4/2014 | E02F 3/434 |
| WO | WO-2016151965 | A1 * | 9/2016 | B60K 6/22 |
| WO | WO-2017036932 | A1 * | 3/2017 | E02F 3/437 |
| WO | WO-2018155202 | A1 * | 8/2018 | |
| WO | WO-2018174154 | A1 * | 9/2018 | |
| WO | WO-2018180555 | A1 * | 10/2018 | |
| WO | WO-2019009341 | A1 * | 1/2019 | |

OTHER PUBLICATIONS

International Search Report for PCT/JP2020/005640 mailed on Apr. 21, 2020.

International Search Report for PCT/JP2020/004045 mailed on Apr. 7, 2020.

Guzman et al., Integrated Mechanical-Electrical Modeling of an AC Electric Mining Shovel and Evaluation of Power Requirements During a Truck Loading Cycle, 2015, IEEE, p. 2590-2599 (Year: 2015).

Bares et al., A robotic excavator for autonomous truck loading, 1998, IEEE, p. 1885-1893 (Year: 1998).

Kang et al., Path tracking for a hydraulic excavator utilizing proportional-derivative and linear quadratic control, 2014, IEEE, p. 808-813 (Year: 2014).

Yamamoto et al., Development of the autonomous hydraulic excavator prototype using 3-D information for motion planning and control, 2010, IEEE, p. 49-54 (Year: 2010).

* cited by examiner

SHOVEL AND SYSTEM

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/005640, filed on Feb. 13, 2020, and designating the U.S., which claims priority to Japanese Patent Application No. 2019-025396 filed on Feb. 15, 2019. The entire contents of the foregoing applications are incorporated herein by reference.

BACKGROUND

Technical Field

The present disclosure relates to a shovel and the like.

Description of Related Art

For example, a shovel of which an end attachment can be changed is known.

SUMMARY

According to an aspect of the present disclosure, provided is a shovel that includes a lower traveling body, an upper turning body turnably mounted on the lower traveling body, a link unit attached to the upper turning body, and a processing circuitry configured to align an end of the link unit with an end attachment to be attached.

EMBODIMENT OF THE INVENTION

For example, a shovel of which an end attachment can be changed is known.

However, in a case where the end attachment is changed, after the currently-attached end attachment is detached, an arm (an attaching portion) is aligned with an end attachment (a counter-attaching portion). Therefore, it may take time to perform the task of aligning, which may decrease the work efficiency of the shovel.

Accordingly, in view of the above problems, it is desired to provide a shovel and the like capable of improving the efficiency of a change task for changing an end attachment.

Hereinafter, modes for carrying out the invention are described with reference to the drawings.

[Overview of Shovel]

Figure 1A:
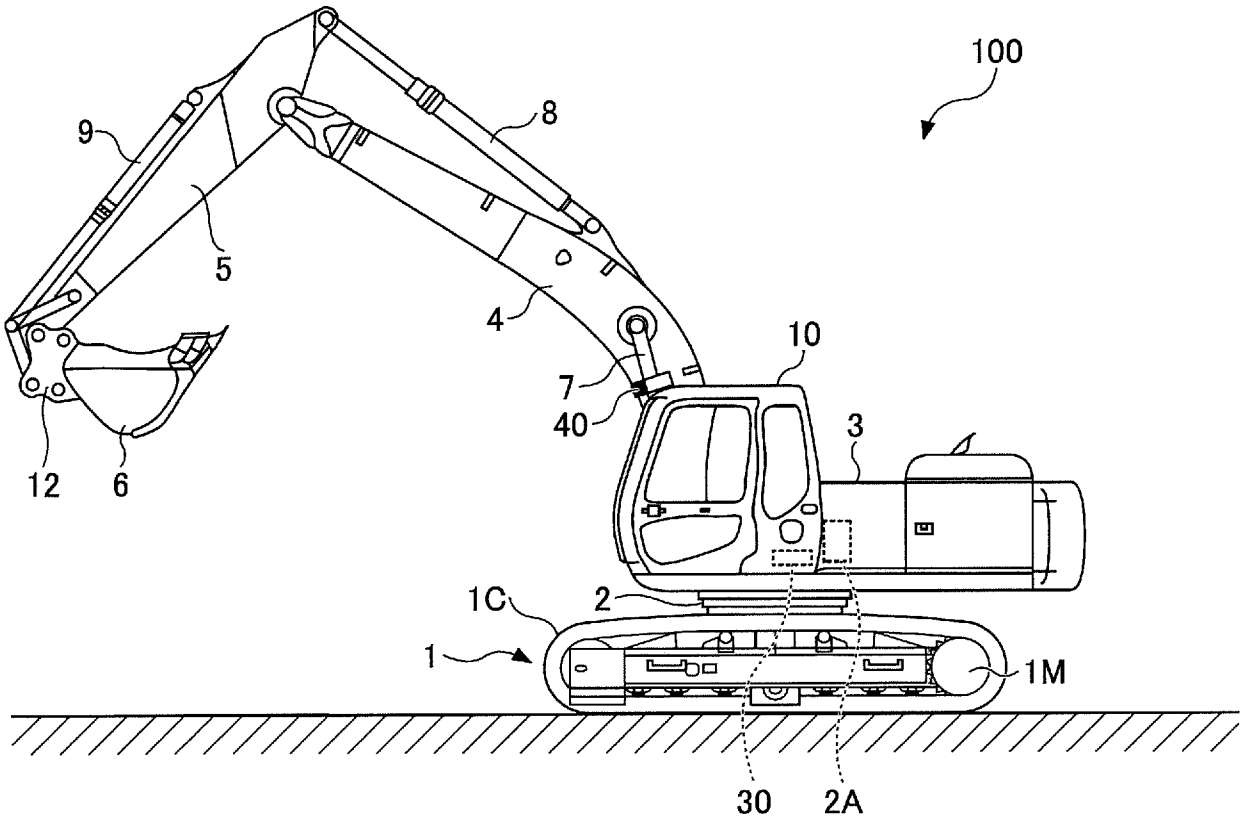
FIG. 1A is a side view illustrating a shovel.
Figure 1B:
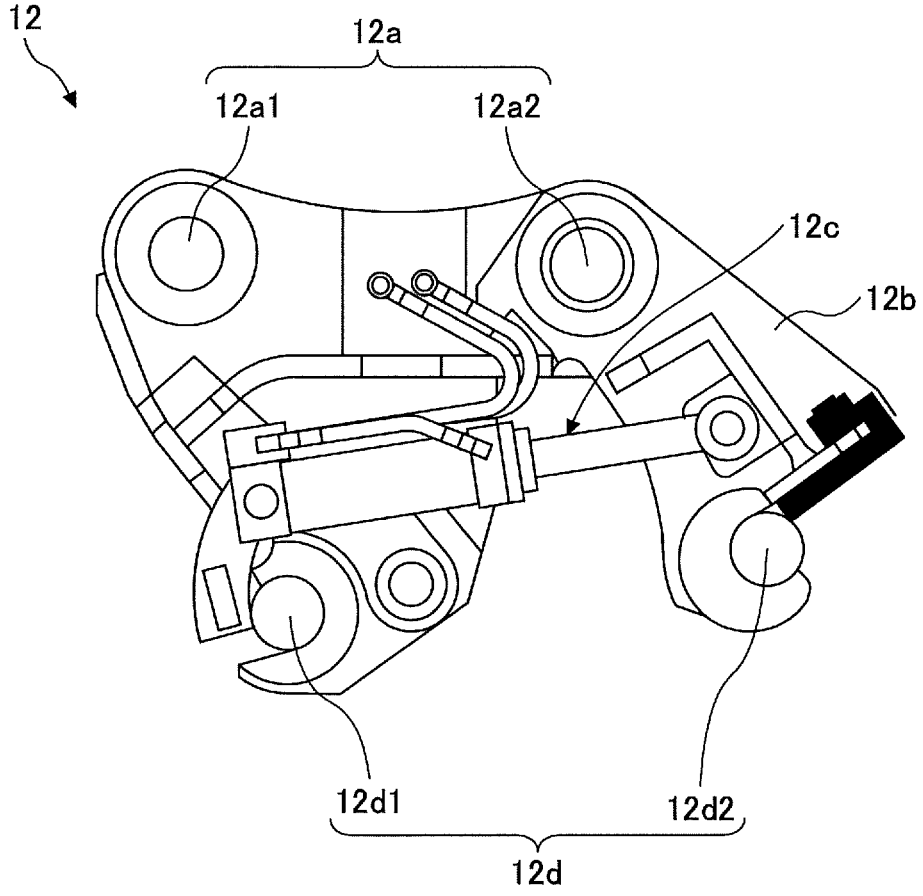
FIG. 1B is a drawing illustrating an example of a detachable apparatus mounted on a shovel.

First, an overview of a shovel 100 according to the present embodiment is explained with reference to FIG. 1 (FIG. 1A and FIG. 1B).

FIG. 1A and FIG. 1B are external views illustrating an overview of the shovel 100 according to the present embodiment. Specifically, FIG. 1A is a side view illustrating an example of the shovel 100 according to the present embodiment, and FIG. 1B is an external view illustrating an example of a detachable apparatus 12 provided in the shovel 100.

As illustrated in FIG. 1A, the shovel 100 according to the present embodiment includes a lower traveling body 1, an upper turning body 3 turnably mounted on the lower traveling body 1 with a turning mechanism 2, a boom 4, an arm 5, an end attachment 6, and a cab 10. The boom 4, the arm 5, and the end attachment 6 constitute an attachment. An operator rides the cab 10. Hereinafter, the front side of the shovel 100 corresponds to the extension direction of the attachment with respect to the upper turning body 3, when the shovel 100 is seen from immediately above along the turning axis of the upper turning body 3 in a plan view (hereinafter simply referred to as a "plan view"). The left side and the right side of the shovel 100 correspond a left side and a right side, respectively, as seen from the operator in the cab 10.

The lower traveling body 1 includes, for example, a pair of right and left crawlers 1C. The crawlers 1C are hydraulically driven by traveling hydraulic motors 1M, i.e., a left side traveling hydraulic motor 1ML and a right side traveling hydraulic motor 1MR (see FIG. 2), to cause the shovel 100 to travel.

The upper turning body 3 is driven by the turning mechanism 2 with a turning hydraulic motor 2A to turn with respect to the lower traveling body 1.

The boom 4 is pivotally attached to the front center of the upper turning body 3 to be able to vertically pivot. The arm 5 is pivotally attached to the end of the boom 4 to be able to pivot vertically. The end attachment 6 is pivotally attached, via the detachable apparatus 12, to the end of the arm 5 to be able to pivot vertically.

The end attachment 6 is attached to the end of the arm 5 in a manner that can be changed as appropriate according to the content of the task of the shovel 100. The end attachment 6 is, for example, as illustrated in FIG. 1A, a bucket. Alternatively, the end attachment 6 may be a type of a bucket different from the bucket illustrated in FIG. 1 (for example, a large bucket that is relatively larger than the bucket in FIG. 1, a bucket for slopes, a bucket for dredging, and the like). Still alternatively, the end attachment 6 may be, for example, a stirrer, a breaker, and the like other than buckets.

As illustrated in FIG. 1B, the detachable apparatus 12 includes a counter-attaching portion 12*a* attached to the arm 5, a movable unit 12*b*, a hydraulic cylinder 12*c* for moving the movable unit 12*b*, and an attaching portion 12*d* for attaching the end attachment 6.

The counter-attaching portion 12*a* is used for attachment to the end of the arm 5. The counter-attaching portion 12*a* includes counter-attaching holes 12*a*1, 12*a*2. The counter-attaching holes 12*a*1, 12*a*2 are attached to corresponding attaching portions (attaching holes) of the end of the arm 5 with the use of predetermined attachment pins.

The movable unit 12*b* is attached so as to be rotatable about the central axis corresponding to the counter-attaching hole 12*a*2.

The end of the rod of the hydraulic cylinder 12*c* is attached to the end of the movable unit 12*b*, and the hydraulic cylinder 12*c* extends and contracts to move the movable unit 12*b*.

The attaching portion 12*d* is used to attach the end attachment 6. The attaching portion 12*d* includes attaching portions 12*d*1, 12*d*2. Among the attaching portions 12*d*1, 12*d*2, the attaching portion 12*d*2 is attached to the end of the movable unit 12*b*, and a distance between the attaching portion 12*d*2 and the attaching portion 12*d*1, serving as a fixed unit, changes according to the operation of the movable unit 12*b*.

Specifically, when the hydraulic cylinder 12*c* contracts, the attaching portion 12*d*2 at the end of the movable unit 12*b* moves closer to the attaching portion 12*d*1. Conversely, when the hydraulic cylinder 12*c* extends, the attaching portion 12*d*2 at the end of the movable unit 12*b* moves away from the attaching portion 12*d*1. Therefore, the detachable apparatus 12 causes the hydraulic cylinder 12*c* to extend to some extent, so that the distance between the attaching portions 12*d*1, 12*d*2 is maintained at the distance between the two counter-attaching portions (for example, attachment pins) provided on the end attachment 6, and accordingly the state in which the end attachment 6 is attached is achieved and maintained. When the hydraulic cylinder 12*c* contracts to cause the distance between the attaching portions 12*d*1, 12*d*2 to be shorter than the distance between two counter-attaching portions provided on the end attachment 6, the detachable apparatus 12 can detach the end attachment 6.

As illustrated in FIG. 1A, the boom 4, the arm 5, and the end attachment 6 are hydraulically driven by a boom cylinder 7, an arm cylinder 8, and an end attachment cylinder 9, respectively, serving as hydraulic actuators.

The cab 10 is an operation room in which the operator rides, and is mounted on the front left of the upper turning body 3.

In accordance with operations performed by the operator who rides the cab 10, the shovel 100 moves driven elements such as the lower traveling body 1 (left and right crawlers 1C), the upper turning body 3, the boom 4, the arm 5, the end attachment 6, and the like.

Instead of or in addition to configurating the shovel 100 to be operable by the operator who rides the cab 10, the shovel 100 may be configured to be remotely operable from the outside of the shovel 100. In a case where the shovel 100 is remotely operated, the cab 10 may be unmanned. In the following explanation, it is assumed that operations of the operator include at least one of: operations performed by the operator of the cab 10 with an operating apparatus 26; or remote operations performed by an outside operator.

The remote operations include, for example, an aspect in which the shovel 100 is operated by an operation input with respect to the actuators of the shovel 100 performed with a predetermined external apparatus. For example, the external apparatus may be a cloud server located relatively far from the work site of the shovel 100. Alternatively, the external apparatus may be, for example, an edge server that is located at a position relatively close to the shovel 100 (for example, a management office in a work site, a base station or a communication center that is relatively close to the work site, and the like). Still alternatively, the external apparatus may be, for example, a terminal apparatus in the work site. The terminal apparatus may be a non-mobile terminal apparatus such as a desktop computer terminal provided in a management office of the work site. Still alternatively, the terminal apparatus may be, for example, a mobile terminal such as a smartphone, a tablet terminal, a laptop computer, or the like that can be carried by a worker, a supervisor, an administrator, or the like of the work site. In this case, for example, the shovel 100 is provided with a communication apparatus that communicates with an external apparatus, and uses the communication apparatus to transmit image information (captured images), which are output from an image-capturing apparatus 40 explained later, to the external apparatus. The image information may be displayed on a display apparatus (hereinafter referred to as a "remote operation display apparatus") provided in the external apparatus. Likewise, various kinds of information images (information screens) displayed on a display apparatus 50, explained later, provided in the cab 10 of the shovel 100 may also be displayed on the remote operation display apparatus of the external apparatus. Accordingly, the operator of the external apparatus can remotely operate the shovel 100, while seeing, for example, the display contents of captured images, information screens, and the like indicating the situations in the surroundings of the shovel 100 that are displayed on the remote operation display apparatus. Then, in response to a remote operation signal indicating the content of a remote operation received by the communication apparatus from the external apparatus, the shovel 100 may move the actuator to drive driven elements such as the lower traveling body 1 (the left and right crawlers 1C), the upper turning body 3, the boom 4, the arm 5, the end attachment 6, and the like.

The remote operations include, for example, an aspect in which the shovel 100 is operated by a speech input, a gesture input, or the like from the outside to the shovel 100 by people in the surroundings of the shovel 100 (for example, workers). Specifically, the shovel 100 recognizes a speech spoken by a worker or the like in the surroundings and a gesture or the like made by a worker or the like, through an audio input apparatus (for example, a microphone), a gesture input apparatus (for example, an image-capturing apparatus), or the like provided in the shovel 100 (i.e., the shovel in question). Then, in response to the content of the recognized speech, gesture, or the like, the shovel 100 may move the actuators to drive driven elements such as the lower traveling body 1 (the left and right crawlers 1C), the upper turning body 3, the boom 4, the arm 5, the end attachment 6, and the like.

Also, the shovel 100 may automatically drive the actuators without relying on the content of the operation by the operator. Accordingly, the shovel 100 achieves the functions for automatically moving at least some of the driven elements such as the lower traveling body 1 (the left and right crawlers 1C), the upper turning body 3, the boom 4, the arm 5, the end attachment 6, and the like (what is termed as an "automatic driving function" or a "machine control function").

The automatic driving function includes a function for automatically operating driven elements (actuators) other than the driven element (actuator) that is to be operated according to the operator's operations with the operating apparatus 26 and the remote operations (what is termed as a "semi-automatic driving function"). Also, the automatic driving function may include a function for automatically moving at least some of the multiple driven elements (actuators) based on the assumption that the operator's operations with the operating apparatus 26 and the remote operations are not performed (what is termed as a "full-automatic driving function"). In the shovel 100, in the case where the full-automatic driving function is activated, the cab 10 may be unmanned. Also, the semi-automatic driving function, the full-automatic driving function, and the like may include an aspect in which operation contents of the driven element (actuator) that is to be automatically driven are automatically determined according to a rule defined in advance. Also, the semi-automatic driving function, the full-automatic driving function, and the like may include an aspect (what is termed as an "autonomous driving function") in which the shovel 100 autonomously makes various kinds of determinations, and may, according to the determination result, autonomously determine operation contents of driven elements (actuators) that are to be automatically driven.

[Configuration of Shovel]

Figure 2A:
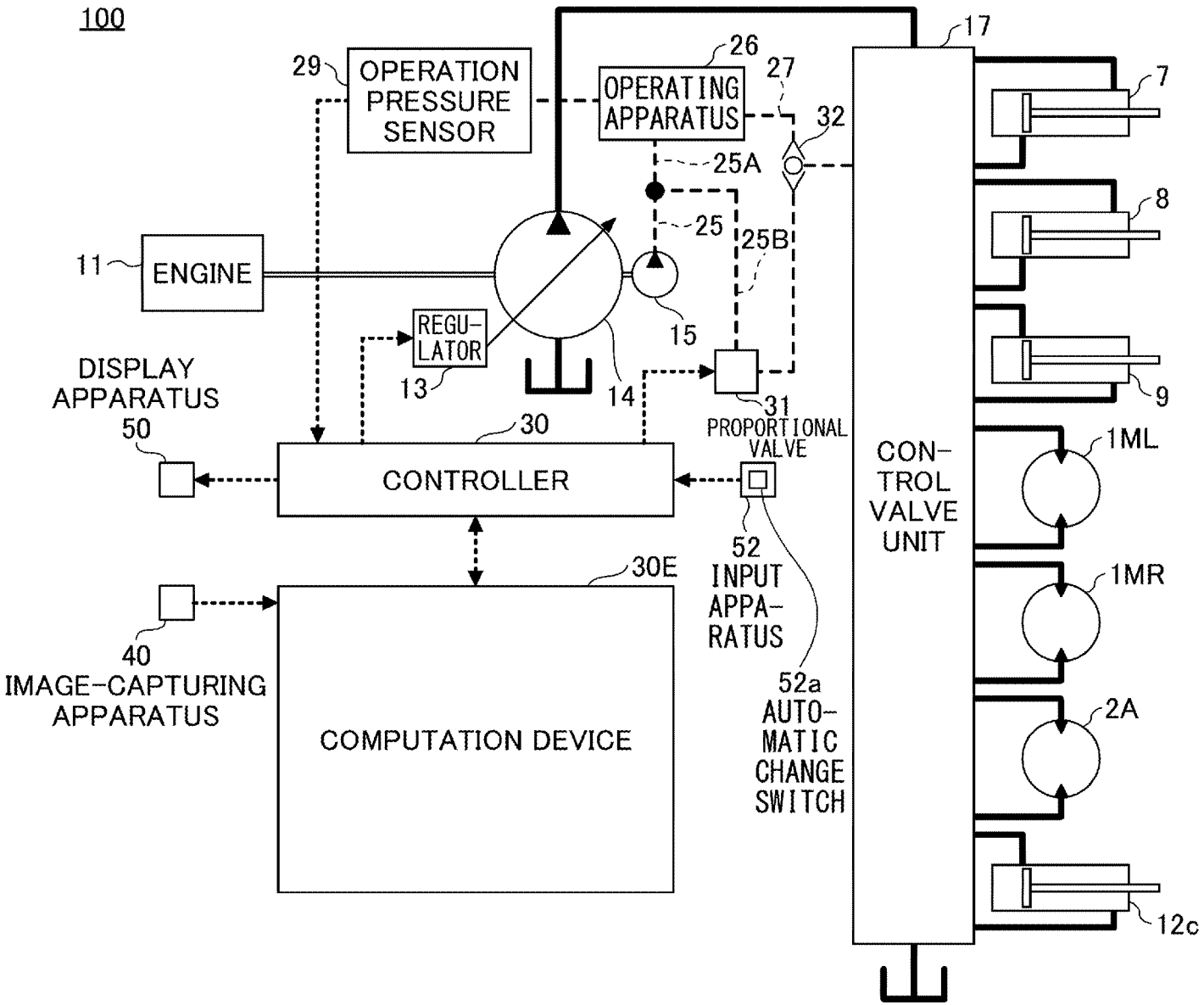
FIG. 2A is a block diagram illustrating an example of configuration of a shovel.
Figure 2B:
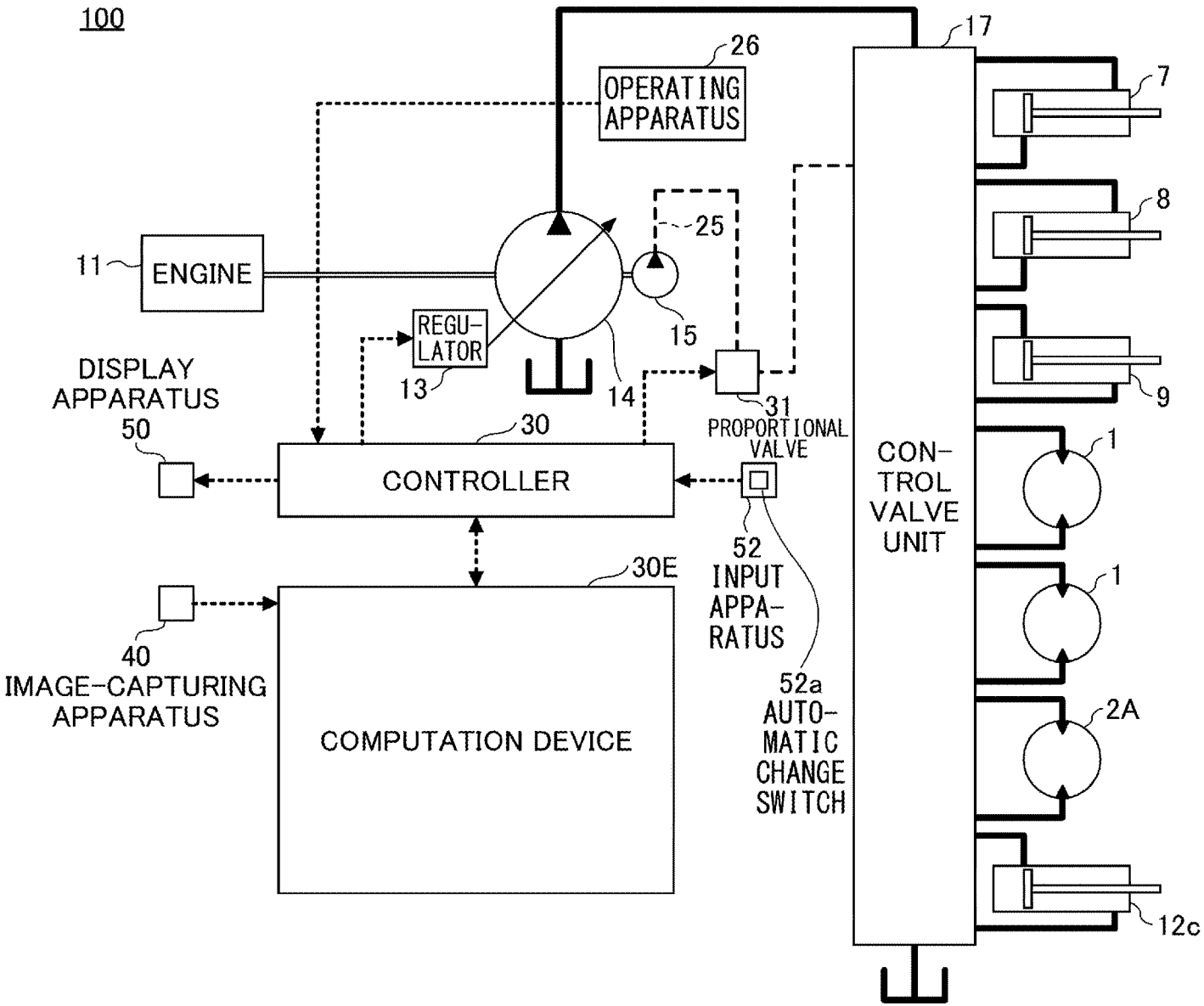
FIG. 2B is a block diagram illustrating another example of configuration of a shovel.

With reference to not only FIG. 1 (FIG. 1A, FIG. 1B) but also FIG. 2 (FIG. 2A, FIG. 2B), a specific configuration of the shovel 100 is explained.

FIG. 2A and FIG. 2B are block diagrams illustrating an example and another example of configurations of the shovel 100 according to the present embodiment.

In the drawings, a mechanical power line, a high-pressure hydraulic line, a pilot line, and an electric drive and control system are indicated by a double line, a thick solid line, a dashed line, and a dotted line, respectively.

<Hydraulic Driving System of Shovel>

As explained above, the hydraulic driving system of the shovel 100 according to the present embodiment includes the hydraulic actuators such as the traveling hydraulic motors 1M (1ML, 1MR), the turning hydraulic motor 2A, the boom cylinder 7, the arm cylinder 8, the end attachment cylinder 9, the hydraulic cylinder 12*c*, and the like for hydraulically driving the lower traveling body 1 (the left and right crawlers 1C), the upper turning body 3, the boom 4, the arm 5, the end attachment 6, and the detachable apparatus 12 (the movable unit 12*b*), and the like, respectively. The hydraulic driving system of the shovel 100 according to the present embodiment includes an engine 11, a regulator 13, a main pump 14, and a control valve unit 17.

The engine 11 is a main power source in the hydraulic drive system, and is, for example, a diesel engine using light oil as fuel. The engine 11 is mounted on the rear part of the upper turning body 3, for example. Specifically, under direct or indirect control by a controller 30 explained later, the engine 11 rotates constantly at a preset target rotational speed, and drives the main pump 14 and a pilot pump 15.

The regulator 13 controls the amount of discharge of the main pump 14 under the control of the controller 30. For example, the regulator 13 adjusts the angle (hereinafter referred to as a "tilt angle") of a swashplate of the main pump 14 according to a control instruction given by the controller 30.

The main pump 14 is mounted, for example, on the rear part of the upper turning body 3, similarly with the engine 11, and supplies hydraulic oil to the control valve unit 17 through a high-pressure hydraulic line. The main pump 14 is driven by the engine 11 as described above. The main pump 14 is, for example, a variable displacement hydraulic pump, in which the regulator 13 controls the tilt angle of the swashplate to adjust the stroke length of a piston under the control performed by the controller 30 as described above, so that the discharge flowrate (discharge pressure) can be controlled.

The control valve unit 17 is a hydraulic control device that is installed, for example, at the center of the upper turning body 3, and that controls the hydraulic drive system according to operator's operation content or according to a control instruction corresponding to automatic movement of the shovel 100 (hereinafter referred to as an "automatic control instruction") that is output from the controller 30. The control valve unit 17 is connected to the main pump 14 via the high-pressure hydraulic line as described above, and hydraulic oil supplied from the main pump 14 is selectively supplied to the hydraulic actuator (the traveling hydraulic motors 1ML, 1MR, the turning hydraulic motor 2A, the boom cylinder 7, the arm cylinder 8, the end attachment cylinder 9, the hydraulic cylinder 12*c*, and the like) according to operator's operation content or according to the automatic control instruction that is output from the controller 30. Specifically, the control valve unit 17 includes multiple control valves (which are also referred to as direction switch valves) that control the flowrates and the flow directions of hydraulic oil supplied from the main pump 14 to the respective hydraulic actuators.

<Control System of Shovel>

The operating system related to the hydraulic driving system of the shovel 100 according to the present embodiment includes a pilot pump 15 and an operating apparatus 26. As illustrated in FIG. 2A, the operating system related to the hydraulic driving system of the shovel 100 includes a shuttle valve 32, in a case where the operating apparatus 26 is of a hydraulic pilot type.

The pilot pump 15 is installed, for example, on the rear part of the upper turning body 3 in a manner similarly to the engine 11, and applies a pilot pressure to various hydraulic apparatuses via a pilot line 25. For example, the pilot pump 15 is a fixed displacement hydraulic pump, and is driven by the engine 11 as described above.

The operating apparatus 26 is provided near the operator's seat of the cab 10, and is operation input means allowing the operator to operate the operation elements (such as the lower traveling body 1, the upper turning body 3, the boom 4, the arm 5, the end attachment 6, and the like). In other words, the operating apparatus 26 is operation input means with which the operator operates the hydraulic actuator (i.e., the traveling hydraulic motors 1ML, 1MR, the turning hydraulic motor 2A, the boom cylinder 7, the arm cylinder 8, the end attachment cylinder 9, and the like) for driving the respective operation elements. For example, the operating apparatus 26 includes lever devices for operating the boom 4 (the boom cylinder 7), the arm 5 (the arm cylinder 8), the end attachment 6 (the end attachment cylinder 9), and the upper turning body 3 (the turning hydraulic motor 2A). Also, for example, the operating apparatus 26 includes pedal devices or lever devices for operating the left and right crawlers 1CL, 1CR (the traveling hydraulic motors 1ML, 1MR) of the lower traveling body 1. Also, for example, the operating apparatus 26 includes a lever device for operating the detachable apparatus 12 (the hydraulic cylinder 12*c*).

For example, as illustrated in FIG. 2A, the operating apparatus 26 is of a hydraulic pilot type. Specifically, the operating apparatus 26 uses hydraulic oil supplied from the pilot pump 15 through the pilot line 25 and a pilot line 25A branched from the pilot line 25, to output the pilot pressure according to the operation content to a pilot line 27 on its secondary side. The pilot line 27 is connected via the shuttle valve 32 to the control valve unit 17. Accordingly, the control valve unit 17 receives via the shuttle valve 32 a pilot pressure corresponding to the operation state of each of various driven elements (hydraulic actuators) with the operating apparatus 26. Accordingly, the control valve unit 17 can drive each of the hydraulic actuators according to the operation state of the operating apparatus 26 by the operator and the like.

For example, as illustrated in FIG. 2B, the operating apparatus 26 is an electric type. Specifically, the operating apparatus 26 outputs an electric signal (hereinafter referred to as an "operation signal") according to the operation content, and the operation signal is retrieved by the controller 30. Then, the controller 30 outputs the content of the operation signal, i.e., a control instruction according to the operation content that is input to the operating apparatus 26 (hereinafter referred to as an "operation control instruction" so as to be distinguished from an automatic control instruction) to a proportional valve 31. Accordingly, the pilot pressure according to the operation content that is input to the operating apparatus 26 is input from the proportional valve 31 to the control valve unit 17, and the control valve unit 17 can drive each of the hydraulic actuators in accordance with the operation content that is input to the operating apparatus 26 by the operator and the like.

A control valve (a direction switch valve) provided in the control valve unit 17 may be of an electromagnetic solenoid type. In this case, an electric signal that is output from the operating apparatus 26 may be directly input to the control valve unit 17, i.e., the control valve of the electromagnetic solenoid type.

As illustrated in FIG. 2A, the shuttle valve 32 includes two inlet ports and one output port, and is configured to output, from the output port, a hydraulic oil having a higher pump pressure from among the pump pressures applied to the two inlet ports. The shuttle valve 32 is provided for each of the driven elements (the crawler 1CL, the crawler 1CR, the upper turning body 3, the boom 4, the arm 5, and the end attachment 6) that is to be operated with the operating apparatus 26. One of the two inlet ports of the shuttle valve 32 is connected to the operating apparatus 26 (specifically, the lever devices or pedal devices explained above included in the operating apparatus 26), and the other of the two inlet ports of the shuttle valve 32 is connected to the proportional valve 31. The output port of the shuttle valve 32 is connected to the pilot port of the corresponding control valve (specifically, the control valve corresponding to the hydraulic actuator that is to be operated with the lever devices or pedal devices explained above connected to one of the inlet ports of the shuttle valve 32) in the control valve unit 17 through the pilot line. Therefore, each of the shuttle valves 32 can apply one of the pump pressure generated by the operating apparatus 26 and the pump pressure generated by the proportional valve 31, whichever is higher, to the pilot port of the corresponding control valve. In other words, the controller 30 outputs, from the proportional valve 31, a pump pressure higher than the secondary-side pump pressure output from the operating apparatus 26 to control the corresponding control valve without relying on the operation of the operating apparatus 26 by the operator. Therefore, the controller 30 can automatically control the operation of the driven element (the lower traveling body 1, the upper turning body 3, the attachment, and the like) without relying on the operation of the operating apparatus 26 by the operator.

<Control System of Shovel>

The control system of the shovel 100 according to the present embodiment includes the controller 30, a computation device 30E, a proportional valve 31, an image-capturing apparatus 40, a display apparatus 50, and an input apparatus 52. As illustrated in FIG. 2A, the control system of the shovel 100 according to the present embodiment includes an operation pressure sensor 29, in a case where the operating apparatus 26 is of a hydraulic pilot type.

The controller 30 performs various controls of the shovel 100. The functions of the controller 30 may be achieved by any given hardware, a combination of hardware and software, and the like. For example, the controller 30 is mainly constituted by a microcomputer including a CPU (Central Processing Unit), a memory device such as a RAM (Random Access Memory), a nonvolatile auxiliary storage device such as a ROM (Read Only Memory), and interface devices, and the like. For example, the controller 30 achieves various functions by causing the CPU to execute one or more programs installed on the auxiliary storage device. The controller 30 and the computation device 30E is an example of a processing circuitry.

For example, the controller 30 may perform control related to operations of the shovel 100 using the operating apparatus 26, in a case where the operating apparatus 26 is of an electric type. Specifically, as described above, the controller 30 may achieve operations of the shovel 100 (specifically, actuators for driving the driven elements) according to the operation content of the operating apparatus 26 by controlling the proportional valve 31 according to the operation signal received from the operating apparatus 26.

For example, the controller 30 performs control related to the remote operation function of the shovel 100. Specifically, the controller 30 may cause the shovel 100 (specifically, actuators for driving the driven elements) to move according to the remote operations by controlling the proportional valve 31 according to the content of remote operations designated by the remote operation signal received from the external apparatus. The controller 30 may cause the shovel 100 to move according to the remote operations in accordance with the content of remote operations corresponding to an audio input and a gesture input received from the worker and the like around the shovel 100.

For example, the controller 30 may perform control related to the automatic driving function of the shovel 100. Specifically, the controller 30 may cause the shovel 100 to move, without relying on the operator's operation, by controlling the proportional valve 31 (i.e., outputting an automatic control instruction to the proportional valve 31) on the basis of a computation result of the computation device 30E (driving instructions of hydraulic actuators). The automatic driving function of the shovel 100 is explained later in detail.

Some of the functions of the controller 30 may be achieved by another controller (control apparatus). In other words, the functions of the controller 30 may be achieved as being distributed among multiple controllers.

The computation device 30E performs computation processing related to various functions of the controller 30 under the control of the controller 30. The functions of the computation device 30E may be achieved by any given hardware, a combination of hardware and software, and the like. For example, the computation device 30E may include a GPU (Graphical Processing Unit), an ASIC (Application Specific Integrated Circuit), an FPGA (field-programmable gate array), and the like to achieve high-speed computation processing.

Specifically, the computation device 30E recognizes the situation around the shovel 100 (the shovel in question) on the basis of output information of the image-capturing apparatus 40, and recognizes various states of the shovel 100 (for example, the orientation state of the upper turning body 3, the orientation state of the attachment, and the like). Then, the computation device 30E calculates and generates driving instructions of hydraulic actuators for automatically moving the shovel 100, on the basis of the recognized situations around the shovel 100 and various states of the shovel 100.

The shovel 100 includes not only the image-capturing apparatus 40 but also a sensor for detecting the state of the shovel 100. For example, the shovel 100 may include a navigation apparatus capable of measuring the absolute position of the shovel in question and an orientation sensor capable of detecting the orientation of the upper turning body 3 and the attachment. The navigation apparatus is, for example, a GNSS (Global Navigation Satellite System) sensor and the like. The orientation sensor is, for example, an angle sensor, an acceleration sensor, an angular acceleration sensor, a six-axis sensor, an IMU (Inertial Measurement Unit), or the like.

The proportional valve 31 is provided for each of the driven elements (the left and right crawlers 1C, the upper turning body 3, the boom 4, the arm 5, the end attachment 6, and the detachable apparatus 12) to be operated with the operating apparatus 26. The proportional valve 31 is provided in the pilot line 25 (the pilot line 25B branched from the pilot line 25 in the case of FIG. 2A) connecting the pilot pump 15 and the control valve unit 17, and configured to be able to change the size of area of flow (i.e., the size of a cross-sectional area in which hydraulic oil can flow). Accordingly, the proportional valve 31 can output a predetermined pilot pressure to the secondary side by using hydraulic oil of the pilot pump 15 supplied through the pilot line 25 (the pilot line 25B). Therefore, via the shuttle valve 32 as illustrated in FIG. 2A, or directly as illustrated in FIG. 2B, the proportional valve 31 can apply, to the control valve unit 17, the predetermined pilot pressure according to the control instruction from the controller 30. Specifically, the controller 30 outputs, to the proportional valve 31, an operation control instruction according to an electric signal from the operating apparatus 26 of the electric type, so that, the pilot pressure according to the operation content of the operating apparatus 26 from the proportional valve 31 is supplied to the control valve unit 17, and the movement of the shovel 100 based on the operator's operation can be achieved. Even in a case where the operator is not operating the operating apparatus 26, the controller 30 outputs, to the proportional valve 31, a control instruction corresponding to the content of the remote operations and the automatic control instruction to supply a predetermined pilot pressure from the proportional valve 31 to the control valve unit 17, so that the remote operation function and the automatic driving function of the shovel 100 can be achieved.

The image-capturing apparatus 40 captures information about the situation of three-dimensional space around the shovel 100, i.e., images around the shovel 100, and obtains image information (hereinafter referred to as a "captured image") representing the situation thereof. The image-capturing apparatus 40 may include, for example, a monocular camera, a stereo camera, depth camera, and the like. The image-capturing apparatus 40 is attached to the upper end of the front surface of the cab 10 to obtain captured images indicating the situation in front of the upper turning body 3. Accordingly, the computation device 30E can recognize the situation in front of the shovel 100 on the basis of the images captured by the image-capturing apparatus 40. The computation device 30E can ascertain the position of the shovel 100, the turning state of the upper turning body 3, and the like, on the basis of the positions of objects recognized from the images captured by the image-capturing apparatus 40. The image-capturing range of the image-capturing apparatus 40 includes the boom 4, the arm 5, and the end attachment 6, i.e., the attachment. Accordingly, the computation device 30E can recognize the orientation state of the attachment on the basis of the attachment condition of the image-capturing apparatus 40 with respect to the upper turning body 3 and the images captured by the image-capturing apparatus 40. Specifically, the image-capturing apparatus 40 can obtain information about the orientation state of the attachment (image information including the attachment).

In addition to the image-capturing apparatus 40, the shovel 100 may be provided with an image-capturing apparatus capturing an image indicating a situation in at least one of the directions, i.e., a rear side, a left side, or a right side of the shovel 100 (the upper turning body 3). Instead of or in addition to the image-capturing apparatus 40, another apparatus (sensor) capable of obtaining information about the situation of three-dimensional space around the shovel 100 may be provided in the shovel 100. The another apparatus (sensor) may be, for example, ultrasonic sensors, a millimeter-wave radar, a LIDAR (Light Detection and Ranging) device, a distance image sensor, an infrared sensor, or the like. The image-capturing apparatus 40 and the another apparatus (sensor) are examples of a first obtaining unit. Also, the image-capturing apparatus 40 and the another apparatus (sensor) are examples of a second obtaining unit.

The display apparatus 50 is provided at a position that can be easily seen by the operator who sits on the seat in the cab 10, and displays various kinds of information images. The display apparatus 50 is, for example, a liquid crystal display and an organic EL (electroluminescence) display.

The input apparatus 52 receives various inputs from the operator. For example, the input apparatus 52 may include an operation input apparatus that is provided in an area that can be reached by the operator who sits on the seat in the cab 10 and that receives various kinds of operation inputs from the operator. For example, the operation input apparatus may include hardware input means such as a touch panel implemented in the display apparatus 50, a touch pad, button switches, levers, and toggle levers provided around the display apparatus 50, knob switches provided in the operating apparatus 26, and the like. The operation input apparatus may include software input means operable by hardware input means, such as virtual operation targets (for example, operation icons) and the like displayed on various operation screens displayed on the display apparatus 50. The input apparatus 52 may include, for example, an audio input apparatus configured to receive an audio input by the operator, a gesture input apparatus and the like configured to receive a gesture input, and the like. The audio input apparatus may include, for example, a microphone. The gesture input apparatus may include, for example, an indoor camera capable of capturing images indicating a gesture operation of the operator in the cab 10. A signal corresponding to an input content to the input apparatus 52 is retrieved by the controller 30.

The input apparatus 52 includes an automatic change switch 52*a*.

The automatic change switch 52*a* is an operation unit that is used to cause the shovel 100 to change the end attachment 6 in an automatic manner or in such a manner as to support the operator's operation. When the automatic change switch 52*a* is turned ON, the controller 30 outputs an automatic control instruction to the proportional valve 31 on the basis of a computation result of the computation device 30E (a driving instruction of the hydraulic actuators) to cause the shovel 100 to perform a change task for changing the end attachment 6 in an automatic manner or in such a manner as to support the operator's operation. The details are explained later (see FIG. 3A to FIG. 3C).

In a case where the shovel 100 is remotely operated by the operator of the external apparatus, an operation unit having the same function as the automatic change switch 52*a* may be provided in the external apparatus. In this case, when the operation unit is operated on the external apparatus, a signal indicating the operation content thereof is transmitted from the external apparatus to the shovel 100. Therefore, in a manner similar to the case where the automatic change switch 52*a* is operated, the controller 30 can cause the shovel 100 to perform a change task for changing the end attachment 6 in an automatic manner or in such a manner as to support the operator's operation. In a case where the remote operations of the shovel 100 are performed according to an audio input or a gesture input by workers and the like around the shovel 100, a predetermined audio input or a predetermined gesture input having the same function as the operation input to the automatic change switch 52*a* may be defined in advance. Accordingly, when the predetermined audio input or the predetermined gesture input is received, the controller 30 can cause, in a manner similar to the case where the automatic change switch 52*a* is operated, the shovel 100 to perform a change task for changing the end attachment 6 in an automatic manner or in such a manner as to support the operator's operation.

As illustrated in FIG. 2A, the operation pressure sensor 29 detects the pilot pressure of the secondary side (the pilot line 27) of the operating apparatus 26, i.e., the pilot pressure corresponding to the operation state of each driven element (hydraulic actuator) of the operating apparatus 26. The controller 30 receives the detection signal of the pilot pressure, detected with the operation pressure sensor 29, corresponding to the operation state related to the lower traveling body 1, the upper turning body 3, the boom 4, the arm 5, the end attachment 6, the detachable apparatus 12, and the like of the operating apparatus 26. Accordingly, the controller 30 can ascertain the operation state of the operating apparatus 26.

[Automatic Driving Function of Shovel]

Next, specific examples of various tasks performed with the automatic driving function of the shovel are explained.

<Excavation Task of Automatic Driving Function>

First, an excavation task performed by the automatic driving function of the shovel 100 is explained.

In a case where an excavation task is performed, the end attachment 6 attached to the shovel 100 is normally a bucket. The excavation task is constituted by, for example, a series of movement steps including an excavation movement, a boom-raising turning movement, an soil-discharging movement, and a boom-lowering turning movement. The excavation movement is a movement of the shovel 100 for excavating the ground. The boom-raising turning movement is a movement of the shovel 100 for scooping the excavated soil into the bucket and moving the soil to the soil-discharging position, and is a complex movement including a raising movement of the boom 4 and a turning movement of the upper turning body 3. The soil-discharging movement is a movement of the shovel 100 for discharging the soil in the bucket to the soil-discharging position. The boom-lowering turning movement is a movement of the shovel 100 for moving (returning) the bucket from the soil-discharging position to the excavation position, and is a complex movement including a lowering movement of the boom 4 and a turning movement of the upper turning body 3.

For example, under the control of the controller 30 and the computation device 30E, the shovel 100 performs an excavation task with the semi-automatic driving function while automatically moving driven elements other than the operation target of the operator according to the operator's operation.

For example, the shovel 100 may perform the excavation movement by not only moving the arm 5 in the closing direction according to an operation of the arm 5 in the closing direction by the operator (hereinafter referred to as an "arm-closing operation") but also automatically moving at least one of the boom 4 or the end attachment 6 (the bucket). Specifically, under the control of the controller 30 and the computation device 30E, the shovel 100 sequentially recognizes the current terrain shape from image information captured by the image-capturing apparatus 40. The shovel 100 generates a target locus of the bucket on the basis of: a difference between the recognized current terrain shape and a target shape (an excavation target surface) of an excavation target such as a predetermined groove; the operator's operation content; and the like. Then, the shovel 100 may achieve an excavation movement with the semi-automatic driving function in such a manner as to automatically move at least one of: the arm 5; or the boom 4 and the bucket, so that the bucket moves along the target locus in accordance with the arm-closing operation of the operator.

For example, the shovel 100 may perform the boom-raising turning movement by automatically moving the boom 4 in the upward direction in addition to the turning movement of the upper turning body 3 according to the operator's operation related to the upper turning body 3 (hereinafter referred to as a "turning operation"). Specifically, in a case where the operator's turning operation is performed after an end condition of the excavation movement is satisfied, the shovel 100 may perform the boom-raising turning movement in accordance with the operator's turning operation. For example, the end condition of the excavation movement may include a condition that the bucket lifts off from the ground (i.e., moves away from the ground), and the shovel 100 can determine whether the condition is satisfied, based on the image information captured by the image-capturing apparatus 40, under the control of the controller 30 and the computation device 30E. Also, the shovel 100 sequentially recognizes the positions and the shapes of the objects in the surroundings on the basis of the image information captured by the image-capturing apparatus 40, under the control of the controller 30 and the computation device 30E. Also, the shovel 100 may generate a target locus of the bucket in which the attachment does not come into contact with the objects in the surroundings on the basis of the recognized positions and shapes of the objects in the surroundings, the operator's operation content, and the like. Then, the shovel 100 may achieve a boom-raising turning movement with the semi-automatic driving function in such a manner as to automatically move the upper turning body 3 and the boom 4 so that the bucket moves along the target locus according to the operator's turning operation.

For example, the shovel 100 may perform the soil-discharging movement by not only moving the bucket in the opening direction according to an operation in the opening direction of the bucket by the operator (hereinafter a "bucket-opening operation") but also automatically moves the arm 5 in the opening direction. Specifically, in a case where the operator performs the bucket-opening operation after the end condition of the boom-raising turning movement is satisfied, the shovel 100 may perform the soil-discharging movement according to the bucket-opening operation by the operator. For example, the end condition of the boom-raising turning movement may include a condition that the operator's turning operation ends. For example, the end condition of the boom-raising turning movement may include, e.g., a condition that the bucket is in a range from a predetermined soil-discharging position in a plan view, and the shovel 100 can determine whether the condition is satisfied, on the basis of the image information captured by the image-capturing apparatus 40 under the control of the controller 30 and the computation device 30E. The shovel 100 sequentially recognizes the positions and shapes of the objects in the surroundings such as a shape of a soil at the soil-discharging position on the basis of the image information captured by the image-capturing apparatus 40 under the control of the controller 30 and the computation device 30E. Also, the shovel 100 generates the target locus of the bucket for discharging soil to a predetermined position at the soil-discharging position, on the basis of the recognized positions and shapes of the objects in the surroundings, the operator's operation content, and the like. Then, the shovel 100 may achieve an soil-discharging movement with the semi-automatic driving function in such a manner as to automatically move the bucket and the arm, so that the bucket moves along the target locus according to the bucket-opening operation of the operator.

For example, the shovel 100 may perform the boom-lowering turning movement by automatically moving the boom 4 in the downward direction in addition to the turning movement of the upper turning body 3 according to the operator's turning operation. Specifically, in a case where the operator's turning operation is performed after the end condition of the soil-discharging movement is satisfied, the shovel 100 may perform the boom-lowering turning movement according to the operator's turning operation. For example, the end condition of the soil-discharging movement may include a condition that the operator's bucket-opening operation ends. For example, the end condition of the soil-discharging movement may include a condition that all the soil in the bucket has been discharged, and the shovel 100 can determine whether the condition is satisfied on the basis of the image information captured by the image-capturing apparatus 40 under the control of the controller 30 and the computation device 30E. The shovel 100 sequentially recognizes the positions and shapes of the objects in the surroundings, including the shape of terrain, on the basis of the image information captured by the image-capturing apparatus 40 under the control of the controller 30 and the computation device 30E. Also, the shovel 100 may generate a target locus of the bucket in which the attachment does not come into contact with the objects in the surroundings and the bucket moves toward the start position of a subsequent excavation movement, on the basis of the recognized positions and shapes of the objects in the surroundings, the operator's operation content, and the like. Then, the shovel 100 may achieve the boom-lowering turning movement with the semi-automatic driving function in such a manner as to automatically move the upper turning body 3 and the boom 4, so that the bucket moves along the target locus according to the operator's turning operation.

In this manner, the shovel 100 can perform an excavation task by repeating the excavation movement, the boom-raising turning movement, the soil-discharging movement, and the boom-lowering turning movement while the driven elements (actuators) other than the operation target are moved automatically according to the operator's operation. Then, the shovel 100 can finish the excavation task by repeating the excavation movement, the boom-raising turning movement, the soil-discharging movement, and the boom-lowering turning movement until the terrain shape matches the predetermined excavation target surface.

For example, the shovel 100 may perform an excavation task with a full-automatic driving function, without relying on the operator's operation, under the control of the controller 30 and the computation device 30E.

For example, the shovel 100 may automatically repeat the excavation movement, the boom-raising turning movement, the soil-discharging movement, and the boom-lowering turning movement, on the basis of a prerequisite condition of the excavation task configured in advance (e.g., an soil-discharging position for discharging soil obtained by excavating the excavation target surface indicating the target shape of the excavation target such as a groove and the like). For example, the prerequisite condition may be set and input with the input apparatus 52 of the cab 10, or may be set on the basis of data related to the prerequisite condition received from a predetermined external apparatus by the communication apparatus. The above is also applicable to a case of a backfilling task explained later. Specifically, the shovel 100 sequentially recognizes the positions and shapes of the objects in the surroundings, including the shape of terrain, on the basis of the image information captured by the image-capturing apparatus 40 under the control of the controller 30 and the computation device 30E. Also, the shovel 100 generates the target locus of the bucket corresponding to the current movement step on the basis of the recognized positions and shapes of the objects in the surroundings and the prerequisite condition. Similarly to the case of the semi-automatic driving function, the movement step may be switched according to a satisfaction of a predetermined end condition. Then, the shovel 100 may automatically repeat the excavation movement, the boom-raising turning movement, the soil-discharging movement, and the boom-lowering turning movement by automatically moving all the driven elements (actuators) corresponding to the current movement step so that the bucket moves along the target locus.

In this manner, the shovel 100 can perform the excavation task by repeating the excavation movement, the boom-raising turning movement, the soil-discharging movement, and the boom-lowering turning movement while automatically moving all the necessary driven elements (actuators) without relying on the operator's operation.

<Back Filling Task with Automatic Driving Function>

Next, the backfilling task with the automatic driving function of the shovel 100 is explained.

In a case where the backfilling task is performed, the end attachment 6 attached to the shovel 100 is usually a bucket. The backfilling task is a task in which, in a state in which an object is installed in a recessed portion such as a groove and the like formed by an excavation task and the like, the shovel 100 moves soil prepared at a position relatively close to the recessed portion to the recessed portion with the bucket to backfill the recessed portion. For example, the backfilling task is constituted by a series of movement steps including the excavation movement, the boom-lowering turning movement, the soil-discharging movement, and the boom-raising turning movement. The excavation movement is a movement of the shovel 100 for scooping (excavating) some soil from a pile of soil. The boom-lowering turning movement is a movement of the shovel 100 for moving soil scooped into the bucket from the pile of soil to the recessed portion, and is a complex movement including a lowering movement of the boom 4 of the shovel and a turning movement of the upper turning body 3. The soil-discharging movement is a movement of the shovel 100 for discharging soil in the bucket to the recessed portion. The boom-raising turning movement is a movement of the shovel 100 for moving the bucket to the soil from the recessed portion, and is a complex movement including the raising movement of the boom 4 and a turning movement of the upper turning body 3.

For example, the shovel 100 performs a backfilling task with the semi-automatic driving function by automatically moving the driven elements other than the operator's operation target according to the operator's operation under the control of the controller 30 and the computation device 30E.

For example, in a manner similarly to the excavation task, the shovel 100 performs an excavation movement by automatically moving at least one of the boom 4 or the bucket in addition to moving the arm 5 in the closing direction according to the operator's arm-closing operation. Specifically, the shovel 100 sequentially recognizes, e.g., the positions and shapes of the objects in the surroundings, including the soil, from the image information captured by the image-capturing apparatus 40 under the control of the controller 30 and the computation device 30E. Also, the shovel 100 generates the target locus of the bucket for scooping soil from the soil into the bucket, on the basis of the recognized positions and shapes of the objects in the surroundings, the operator's operation content, and the like. Then, the shovel 100 may achieve the excavation movement with the semi-automatic driving function in such a manner as to automatically move the arm 5 and at least one of the boom 4 or the bucket so that the bucket moves along the target locus according to the operator's arm-closing operation.

For example, in a manner similarly to the excavation task, the shovel 100 may perform the boom-lowering turning movement by automatically moving the boom 4 in the downward direction in addition to turning the upper turning body 3 according to the operator's turning operation. Specifically, in a case where the operator's turning operation is performed after the end condition of the excavation movement is satisfied, the shovel 100 may perform the boom-lowering turning movement according to the operator's turning operation. For example, the end condition of the excavation movement may include a condition that the bucket lifts off from the ground. The shovel 100 sequentially recognizes the positions and shapes of the objects in the surroundings on the basis of the image information captured by the image-capturing apparatus 40 under the control of the controller 30 and the computation device 30E. Also, the shovel 100 may generate a target locus of the bucket in which the attachment does not come into contact with the objects in the surroundings on the basis of the recognized positions and shapes of the objects in the surroundings, the operator's operation content, and the like. Then, the shovel 100 may achieve the boom-lowering turning movement with the semi-automatic driving function in such a manner as to automatically move the upper turning body 3 and the boom 4 so that the bucket moves along the target locus according to the operator's turning operation.

Also, for example, the shovel 100 may perform an soil-discharging movement by automatically moving the arm 5 in the opening direction in addition to moving the bucket in the opening direction according to the operator's bucket-opening operation. Specifically, in a case where the operator performs a bucket-opening operation after the end condition of the boom-lowering turning movement is satisfied, the shovel 100 may perform a soil-discharging movement according to the operator's bucket-opening operation. For example, the end condition of the boom-lowering turning movement may include a condition that the operator's turning operation ends. For example, the end condition of the boom-lowering turning movement may include, e.g., a condition that the bucket is in a range from the recessed portion to be filled in a plan view, and the shovel 100 can determine whether the condition is satisfied on the basis of the image information captured by the image-capturing apparatus 40 under the control of the controller 30 and the computation device 30E. The shovel 100 sequentially recognizes the current terrain shape (the degree as to how much the buried object is buried in the recessed portion) on the basis of the image information captured by the image-capturing apparatus 40 under the control of the controller 30 and the computation device 30E. Also, the shovel 100 may generate a target locus of the bucket for discharging soil to a predetermined position of the recessed portion, on the basis of a difference between the recognized current terrain shape and the target shape of the ground to be backfilled defined in advance (excavation target surface), the operator's operation content, and the like. Then, the shovel 100 may achieve the soil-discharging movement with the semi-automatic driving function in such a manner as to automatically move the bucket and the arm so that the bucket moves along the target locus according to the operator's bucket-opening operation.

For example, the shovel 100 may perform the boom-raising turning movement by automatically moving the boom 4 in the upward direction in addition to turning the upper turning body 3 according to the operator's turning operation. Specifically, in a case where the operator's turning operation is performed after the end condition of the soil-discharging movement is satisfied, the shovel 100 may perform the boom-raising turning movement according to the operator's turning operation. For example, the end condition of the soil-discharging movement may include a condition that the operator's bucket-opening operation ends. For example, the end condition of the soil-discharging movement may include a condition that all the soil in the bucket has been discharged. The shovel 100 sequentially recognizes the positions and shapes of the objects in the surroundings, including the shape of terrain, on the basis of the image information captured by the image-capturing apparatus 40 under the control of the controller 30 and the computation device 30E. The shovel 100 may generate a target locus of the bucket in which the attachment does not come into contact with the objects in the surroundings and the bucket moves toward the start position (soil) of a subsequent excavation movement, on the basis of the recognized positions and shapes of the objects in the surroundings, the operator's operation content, and the like. Then, the shovel 100 may achieve the boom-raising turning movement with the semi-automatic driving function in such a manner as to automatically move the upper turning body 3 and the boom 4, so that the bucket moves along the target locus according to the operator's turning operation.

In this manner, the shovel 100 can perform a backfilling task by repeating the excavation movement, the boom-lowering turning movement, the soil-discharging movement, and the boom-raising turning movement, while automatically moving the driven elements (actuators) other than the operation target according to the operator's operation. Then, the shovel 100 can finish the backfilling task by repeating the excavation movement, the boom-lowering turning movement, the soil-discharging movement, and the boom-raising turning movement until the recessed portion is backfilled to match the excavation target surface.

For example, the shovel 100 may perform the backfilling task with the full-automatic driving function without relying on the operator's operation under the control of the controller 30 and the computation device 30E.

For example, the shovel 100 may automatically repeat the excavation movement, the boom-lowering turning movement, the soil-discharging movement, and the boom-raising turning movement, on the basis of the prerequisite condition of the backfilling task configured in advance (the position of the recessed portion of the backfilling target, the excavation target surface corresponding to the target shape of the backfilled ground, the position of the soil prepared for backfilling, and the like). Specifically, the shovel 100 sequentially recognizes the positions and shapes of the objects in the surroundings, including the shape of terrain, on the basis of the image information captured by the image-capturing apparatus 40 under the control of the controller 30 and the computation device 30E. The shovel 100 generates a target locus of the bucket corresponding to the current movement step on the basis of the recognized positions and shapes of the objects in the surroundings and the prerequisite condition. Similarly to the case of the semi-automatic driving function, the movement step may be switched according to a satisfaction of a predetermined end condition. Then, the shovel 100 may automatically repeat the excavation movement, the boom-lowering turning movement, the soil-discharging movement, and the boom-raising turning movement by automatically moving all the driven elements (actuators) corresponding to the current movement step so that the bucket moves along the target locus.

In this manner, without relying on the operator's operation, the shovel 100 can perform the backfilling task by repeating the excavation movement, the boom-lowering turning movement, the soil-discharging movement, and the boom-raising turning movement while automatically moving all the necessary driven elements (actuators).

<Change Task for Changing End Attachment with Automatic Driving Function>

Figure 3A:
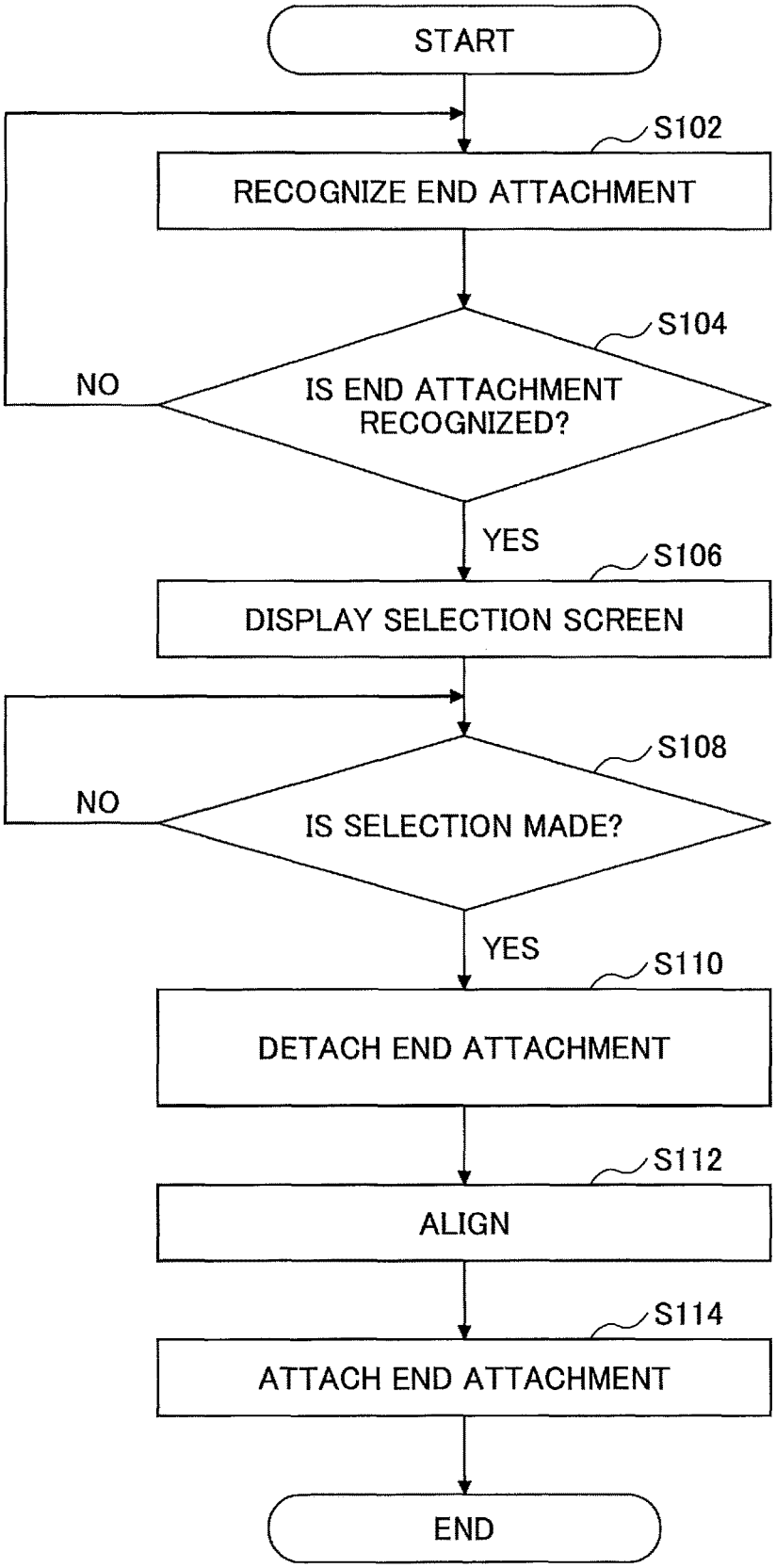
FIG. 3A is a flowchart schematically illustrating an example of control processing performed by a controller for a change task for changing an end attachment with an automatic driving function of the shovel.
Figure 3B:
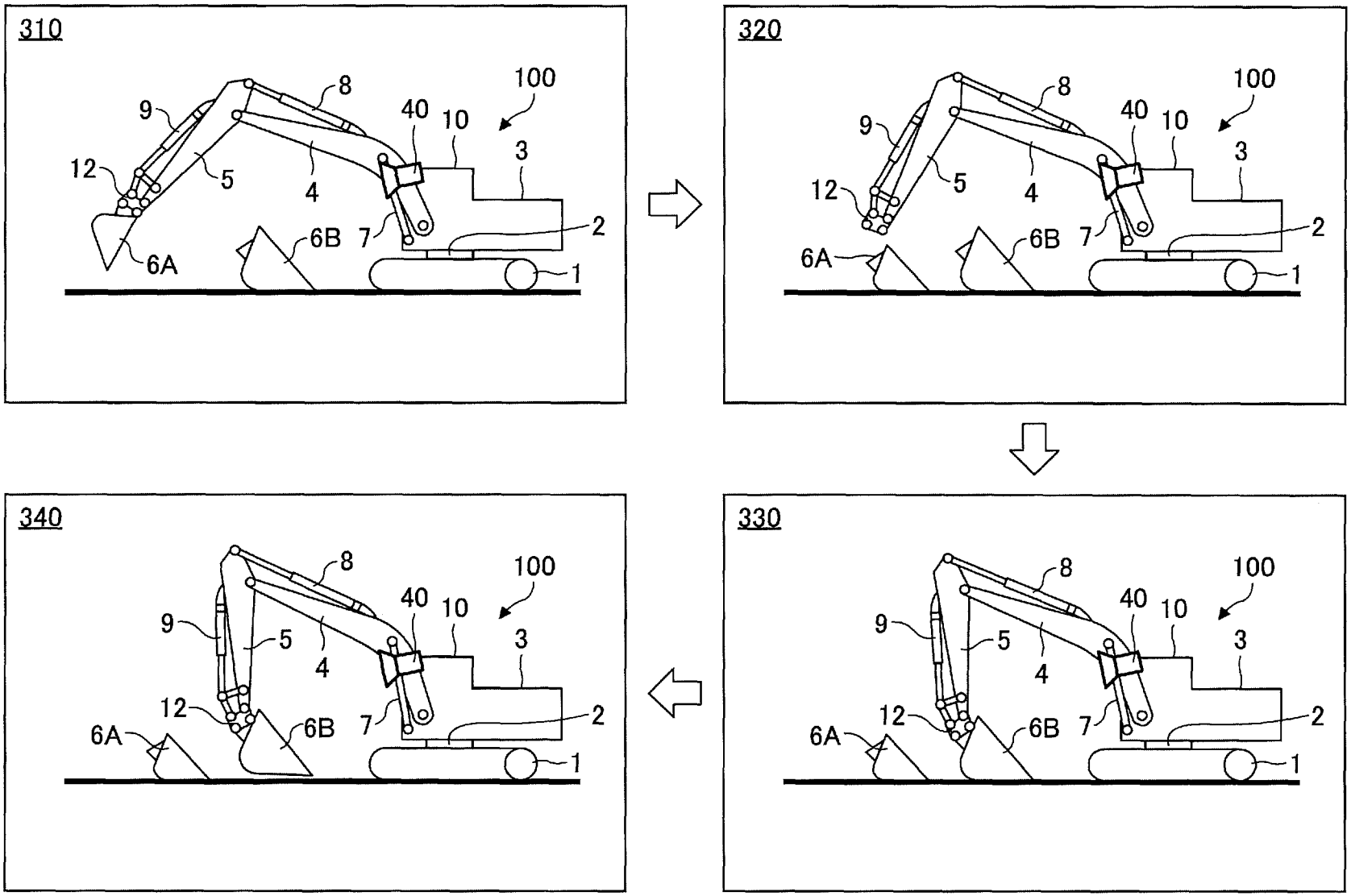
FIG. 3B is a drawing illustrating an example of a change task for changing the end attachment with the automatic driving function of the shovel.
Figure 3C:
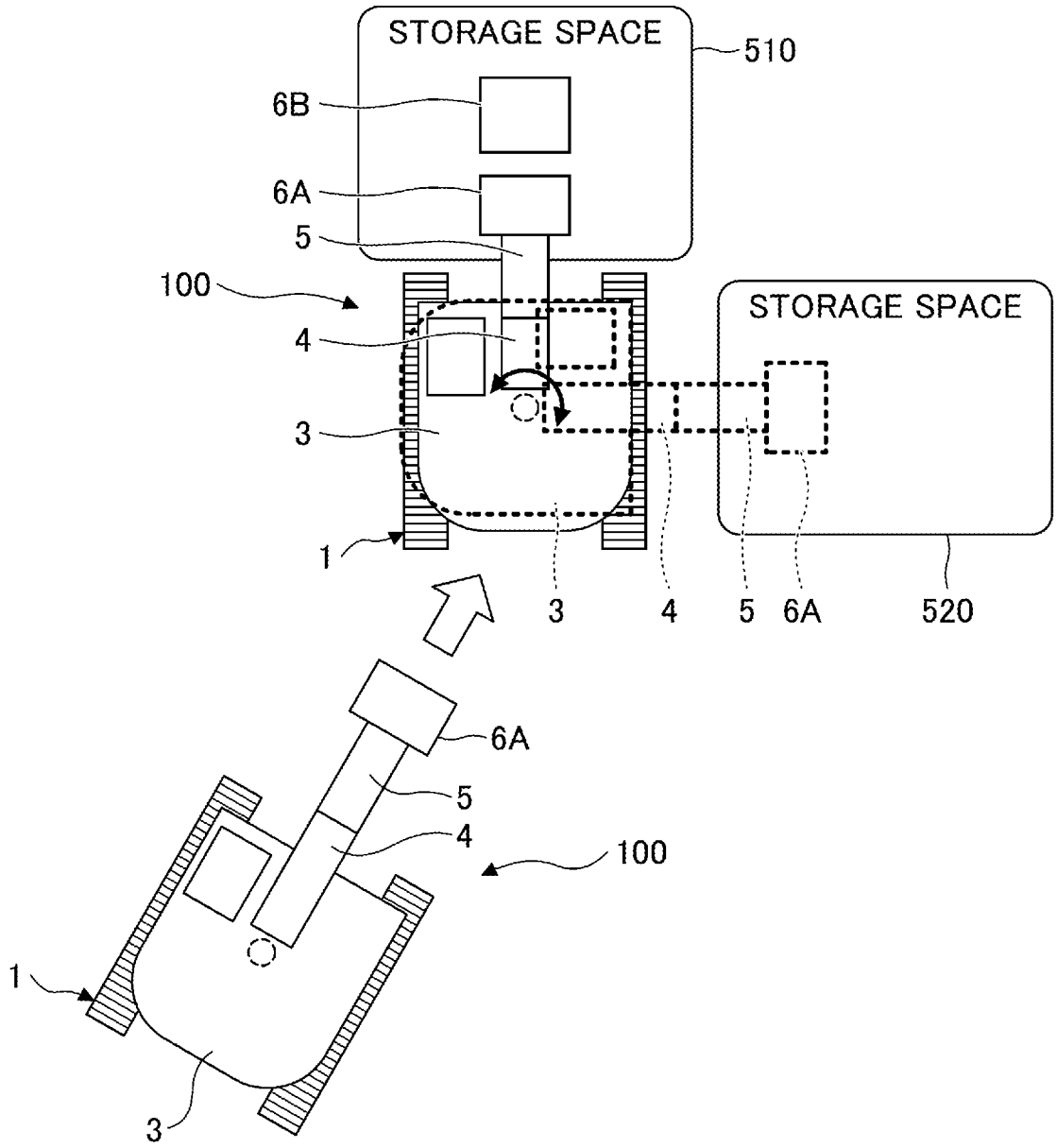
FIG. 3C is a drawing illustrating another example of a change task for changing the end attachment with the automatic driving function of the shovel.
Figure 4A:
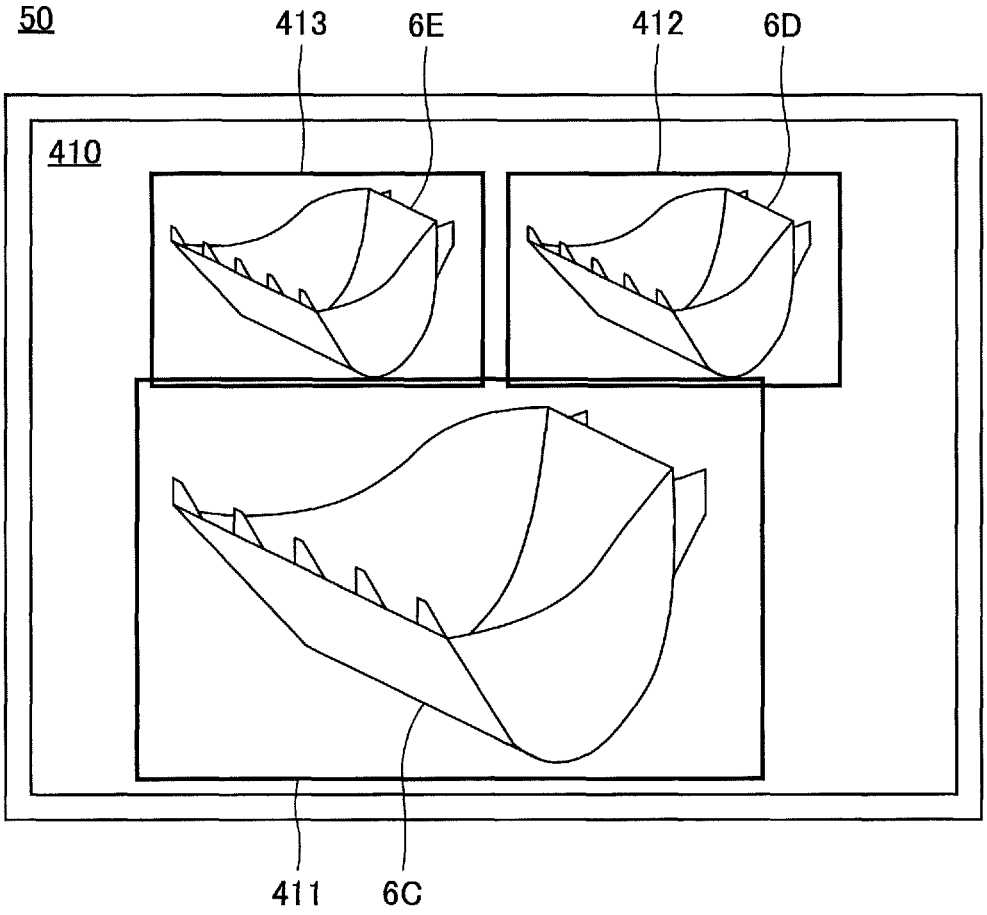
FIG. 4A is a drawing illustrating a first example of a replacement selection screen.
Figure 4B:
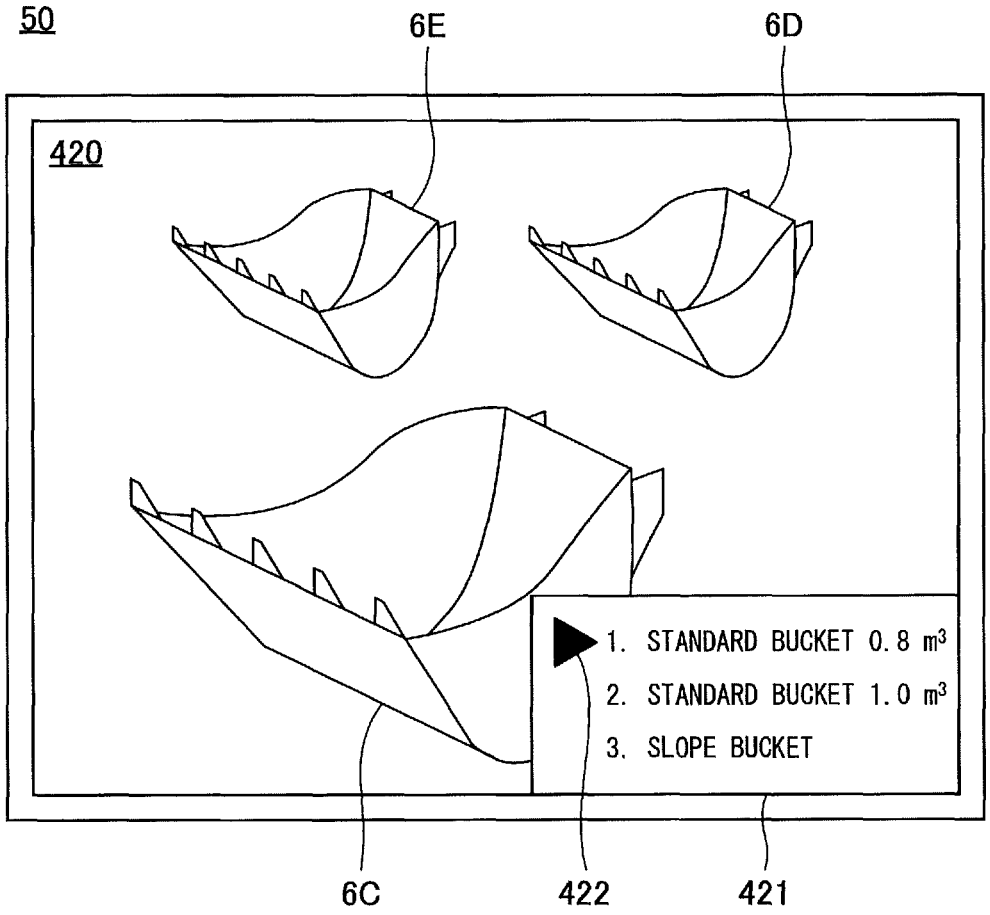
FIG. 4B is a drawing illustrating a second example of a replacement selection screen.
Figure 4C:
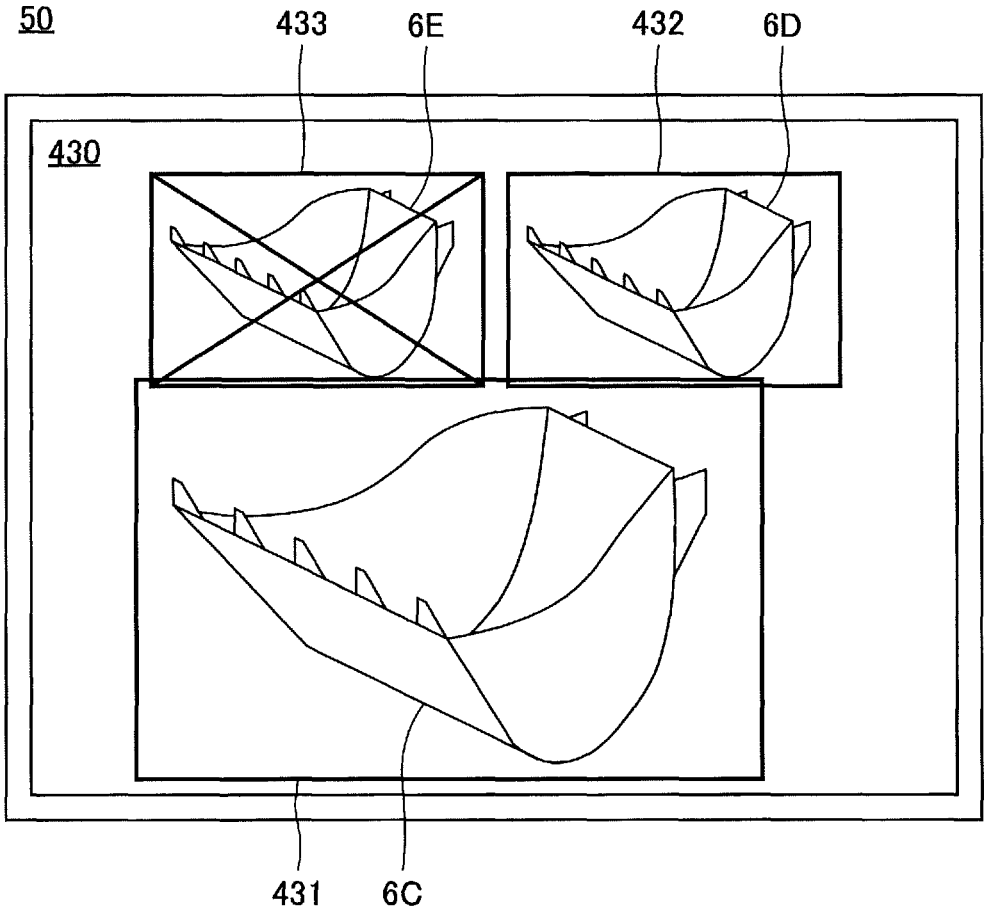
FIG. 4C is a drawing illustrating a third example of a replacement selection screen.

Next, the change task for changing the end attachment 6 with the automatic driving function of the shovel 100 according to the present embodiment is explained with reference to FIG. 3 (FIG. 3A to FIG. 3C) and FIG. 4 (FIG. 4A to FIG. 4C).

For example, the shovel 100 may perform the change task for changing the end attachment 6 with the full-automatic driving function without relying on the operator's operation under the control of the controller 30 and the computation device 30E.

FIG. 3A to FIG. 3C are drawings for explaining the change task for changing the end attachment 6 with the automatic driving function of the shovel 100. Specifically, FIG. 3A is a flowchart schematically illustrating an example of control processing performed by the controller 30 with respect to the change task for changing the end attachment with the automatic driving function of the shovel 100. For example, when the automatic change switch 52*a* is turned ON, this flowchart is started. FIG. 3B is a drawing illustrating an example of the change task for changing the end attachment 6 with the automatic driving function of the shovel 100. Specifically, FIG. 3B is a task state transition diagram illustrating a task state 310 to a task state 340 of the change task for changing the end attachment 6 with the automatic driving function of the shovel 100. FIG. 3C is a drawing illustrating another example of the change task for changing the end attachment 6 with the automatic driving function of the shovel 100. FIG. 3B and FIG. 3C illustrate specific examples of the change task for changing the end attachment 6 with the automatic driving function of the shovel 100 in a case where a bucket 6A attached to the shovel 100 is changed to a bucket 6B. FIG. 4A to FIG. 4C are drawings illustrating a first example to a third example, respectively, of operation screens (hereinafter referred to as a "replacement selection screens") for selecting a replacement end attachment, displayed on the display apparatus 50. FIG. 4A to FIG. 4C illustrate cases where the buckets 6C to 6E placed on the ground around the shovel 100 are recognized as replacement end attachments by the computation device 30E.

As illustrated in FIG. 3A, in step S102, the computation device 30E attempts to recognize end attachments placed on the ground around the shovel 100 on the basis of images captured by the image-capturing apparatus 40 under the control of the controller 30.

For example, as illustrated in the task state 310 of FIG. 3B, in this example, the shovel 100 moves to a position where a replacement bucket 6B is stored (a storage space) according to the operator's operation, so that the shovel 100 is arranged at a position directly facing the bucket 6B. The state in which the shovel 100 and the replacement bucket 6B directly face each other means a state in which the attaching portion at the end of the arm 5 can be aligned with the counter-attaching portion of the replacement bucket 6B only by moving the end (specifically, the detachable apparatus 12) of the arm 5 in at least one of the forward-and-backward direction or the vertical direction. Specifically, the state in which the shovel 100 and the replacement bucket 6B directly face each other corresponds to a state in which the work plane of the attachment perpendicularly intersects the center in the width direction of the counter-attaching portion of the replacement bucket 6B. The work plane of the attachment is a plane perpendicular to the rotation axes of the boom 4, the arm 5, and the end attachment 6, and means a plane in which the central portion in the width direction (left-and-right direction) of the attachment performs actions in a case where the attachment moves. In this example, the shovel 100 (the computation device 30E) can recognize the bucket 6B, serving as a replacement end attachment, placed on the ground in front of (in the forward direction of) the upper turning body 3 on the basis of images captured by the image-capturing apparatus 40.

Also, for example, as illustrated in FIG. 3C, in this example, the shovel 100 is arranged at the position relatively away from the replacement bucket 6B (see the shovel 100 on the lower side in the drawing). Therefore, the shovel 100 cannot cause the end of the arm 5 to reach the replacement bucket 6B with only the movement of the attachment (the boom 4 and the arm 5). The replacement bucket 6B may be included in an image captured by the image-capturing apparatus 40. Therefore, the shovel 100 (the computation device 30E) can recognize the replacement bucket 6B placed on a storage space 510 relatively away from the upper turning body 3 in the diagonally forward left direction on the basis of images captured by the image-capturing apparatus 40.

Returning to FIG. 3A, when the processing of step S102 with the computation device 30E is finished, the controller 30 proceeds to step S104.

In step S104, the controller 30 determines whether the computation device 30E has recognized any end attachment as a result of the processing of step S102. In a case where the computation device 30E has recognized the end attachment, the controller 30 proceeds to step S106, and in a case where the computation device 30E has not recognized any end attachment, the computation device 30E repeats the processing of steps S102, S104 until the computation device 30E recognizes an end attachment.

In a case where the computation device 30E does not recognize any end attachment, the controller 30 may notify to the operator that any end attachment is not recognized on the display apparatus 50. Accordingly, the controller 30 can prompt the operator to operate the operating apparatus 26 so as to cause the shovel 100 to travel, with the lower traveling body 1, to a position where the image-capturing apparatus 40 can capture an image of a replacement end attachment, or turn the upper turning body 3. In a case where the computation device 30E does not recognize any end attachment, the controller 30 may control, on the basis of a driving instruction generated by the computation device 30E, the proportional valve 31 to cause the shovel 100 to automatically travel with the lower traveling body 1 or automatically turn the upper turning body 3 to the position where the end attachment can be recognized. In a case where the computation device 30E does not recognize any end attachment even when a certain period of time elapses, this flowchart may be forcibly ended.

In step S106, the controller 30 cause on the display apparatus 50 to display a replacement selection screen for selecting a replacement end attachment from among the end attachments recognized by the computation device 30E. This is because multiple candidates of replacement end attachments may be recognized.

For example, as illustrated in FIG. 4A, an image including buckets 6C to 6E serving as candidates of replacement end attachments recognized by the computation device 30E, generated based on images captured by the image-capturing apparatus 40, is displayed on a replacement selection screen 410. In the areas including (showing) the buckets 6C to 6E, recognition frames 411 to 413 indicating that the buckets 6C to 6E are recognized by the computation device 30E, i.e., the buckets 6C to 6E are candidates of replacement end attachments, are displayed in an overlapping manner in the replacement selection screen 410. A user such as an operator can select a replacement end attachment (bucket) from among the buckets 6C to 6E by performing operations to designate (select) and confirm any one of the recognition frames 411 to 413 with the input apparatus 52 (for example, a touch panel or the like implemented in the display apparatus 50).

For example, as illustrated in FIG. 4B, the image including the buckets 6C to 6E are displayed in the replacement selection screen 420 in a manner similar to the case of FIG. 4A. List information 421 for identifying the types of the buckets 6C to 6E recognized by the computation device 30E is displayed as a pop-up in the replacement selection screen 420. Specifically, the controller 30 or the computation device 30E may generate the list information 421 by automatically determining the types of candidates of end attachments (the buckets 6C to 6E) recognized by the computation device 30E on the basis of information about multiple types of end attachments registered in a database of end attachments established in advance. The database of end attachments may be established in an auxiliary storage device and the like of the controller 30, or may be established in an external storage device communicably connected to the controller 30. In this example, the names of three types of end attachments (buckets) including a "standard bucket 0.8 $m^3$", a "standard bucket 1.0 $m^3$", and a "slope bucket" corresponding to the recognized buckets 6C to 6E, respectively, are listed in the list information 421. A user such as an operator selects any given type of bucket from among the buckets 6C to 6E by moving a selection icon 422 in the list information 421 with the input apparatus 52, and performs a predetermined confirmation operation, so that the selection can be confirmed.

For example, as illustrated in FIG. 4C, in a manner similarly to FIG. 4A, the image including the buckets 6C to 6E is displayed in the replacement selection screen 430. In a manner similar to FIG. 4A, the recognition frames 431 to 433 indicating that they are recognized by the computation device 30E, i.e., that they are candidates of replacement end attachments, are displayed in an overlapping manner in the portions including (showing) the buckets 6C to 6E, respectively, in the replacement selection screen 430. In this example, among the recognition frames 431 to 433, the recognition frames 431, 432 for the candidates of replacement end attachments (the buckets 6C, 6D) that can be attached to the shovel 100 are different from the recognition frame 433 for the candidate of replacement end attachment (the bucket 6E) that cannot be attached to the shovel 100. Specifically, the recognition frame 433 includes an X mark constituting diagonal lines of the rectangular portion to indicate that the bucket 6E cannot be selected. The controller 30 can inhibit the end attachment that cannot be attached to the shovel 100 due to the technical specification from being erroneously attached to the shovel 100. Specifically, the controller 30 or the computation device 30E may automatically determine the types of the buckets 6C to 6E recognized by the computation device 30E and determine whether they can be attached to the shovel 100, on the basis of information about multiple types of end attachments registered in the database of end attachments established in advance. A user such as an operator can select, except the recognition frame 433 that cannot be selected, a replacement end attachment (bucket) of one of the buckets 6C, 6D by designating (selecting) any one of recognition frames 431, 432 and performing an operation of confirmation with the input apparatus 52.

Returning to FIG. 3A, when the processing of step S106 is finished, the controller 30 proceeds to step S108.

Even in a case where only one replacement end attachment is recognized in the processing of step S102, the replacement selection screen may be displayed. This is because whether the recognized replacement end attachment is an end attachment desired by the user (the operator) can be confirmed by the user.

In step S108, the controller 30 can determine whether a selection of a replacement end attachment has been confirmed in the replacement selection screen. In a case where a selection of a replacement end attachment has been confirmed, the controller 30 proceeds to step S110, and in a case where a selection of a replacement end attachment has not been confirmed, the controller 30 waits until a selection has been confirmed (repeats the processing of the steps until a selection has been confirmed).

In a case where a selection of a replacement end attachment is not confirmed even if a certain period of time elapses, this flowchart may forcibly ended.

In step S110, on the basis of a driving instruction generated by the computation device 30E, the controller 30 controls the proportional valve 31, and detaches the end attachment 6 currently attached to the end of the arm 5 (i.e., the detachable apparatus 12) of the shovel 100 and places it to a predetermined position. For example, the predetermined position is a storage space of a work site provided in advance for storing multiple types of end attachments that can be attached to the shovel 100.

For example, as illustrated in the task state 320 of FIG. 3B, in this example, the shovel 100 detaches the currently attached bucket 6A and places it to the same storage space in which the replacement bucket 6B is placed. For example, the shovel 100 performs at least one of the lowering movement of the boom 4 or the closing movement of the arm 5, until the back surface of the bucket 6A comes into contact with the ground surface of the storage space further ahead of the bucket 6B as seen from the shovel 100, under the control of the controller 30 and the computation device 30E. Then, the shovel 100 moves the hydraulic cylinder 12*c* in a contracting direction under the control of the controller 30 and the computation device 30E, so that the bucket 6A can be detached and placed to the storage space.

For example, as illustrated in FIG. 3C, in this example, as described above, the current position of the shovel 100 is relatively away from the storage space 510 where the replacement bucket 6B is placed (see the shovel 100 on the lower side in the drawing). Therefore, the shovel 100 may move closer to the storage space 510, where the replacement bucket 6B is placed, by causing the lower traveling body 1 to automatically travel under the control of the controller 30 and the computation device 30E (see the shovel 100 on the upper side in the drawing). Specifically, similarly to the case of FIG. 3B, the shovel 100 may detach and place the bucket 6A to the storage space 510 upon automatically moving (travelling) until the shovel 100 faces the replacement bucket 6B and the end of the arm 5 (the detachable apparatus 12) is ready to reach the bucket 6B. Accordingly, only by moving the end of the arm 5 in the front-and-rear direction and the vertical direction, the shovel 100 can align the end of the arm 5 with the attaching-target bucket 6B. Specifically, (a portion of) the movement of the shovel 100 for detaching the currently attached end attachment 6 (the bucket 6A) may constitute a portion of the task for aligning the end of the arm 5 with the end attachment (the bucket 6B). In this case, the shovel 100 may automatically transition to the state of facing the bucket 6B while adjusting the direction of the upper turning body 3 with only the traveling movement of the lower traveling body 1 while the front-and-rear direction (the longitudinal direction) of the lower traveling body 1 (the crawler 1C) substantially matches with the direction of the upper turning body 3. In other words, the shovel 100 may automatically transition to the state of facing the bucket 6B by changing the traveling direction by adjusting the respective driving speeds of the left and right crawlers 1C. Alternatively, the shovel 100 may automatically transition to the state of facing the bucket 6B by changing the direction of the upper turning body 3 by using both of the traveling movement of the lower traveling body 1 and the turning movement of the upper turning body 3.

The shovel 100 may be able to achieve the state of facing a replacement end attachment only by being located at a position, at which the end of the arm 5 can reach a replacement end attachment, and turning the upper turning body 3. Specifically, this corresponds to a state of the shovel 100 in which, when a replacement end attachment is seen from the turning axis of the upper turning body 3, the replacement end attachment is at a relatively short distance, and a plane corresponding to a radius direction perpendicularly intersects the central portion in the width direction of counter-attaching portion of the replacement end attachment. The shovel 100 can recognize this state on the basis of image information captured by an image-capturing apparatus capable of capturing images on the left side, the right side, the rear side, and the like of the image-capturing apparatus 40 and the shovel 100, under the control of the controller 30 and the computation device 30E. In this case, the shovel 100 may automatically transition to the state of facing the replacement end attachment with only the turning movement of the only upper turning body 3.

For example, as illustrated in FIG. 3C, the shovel 100 may detach and place the bucket 6A to a storage space 520 that is different from the storage space 510, where the replacement bucket 6B is placed, under the control of the controller 30 and the computation device 30E (see the shovel 100 indicated by broken lines in the drawing). In this example, the shovel 100 aligns the direction of the attachment to the storage space 520 by automatically turning the upper turning body 3, after transitioning to the state in which the end of the arm 5 can reach and faces the replacement bucket 6B of the storage space 510. Accordingly, by only detaching and placing the bucket 6A to the storage space 520 and turning in the opposite direction by the same turning amount, the shovel 100 can return back to the original state, i.e., a state in which the end of the arm 5 can reach and faces the replacement bucket 6B.

In this manner, in step S110, the shovel 100 may perform a movement for transitioning to a state in which the end of the arm 5 can reach and is facing a replacement end attachment (hereinafter referred to as a "directly-facing movement") before a movement for detaching the end attachment 6 (hereinafter referred to as a "detaching movement").

Returning to FIG. 3A, when the processing of step S110 is finished, the controller 30 proceeds to step S112.

In step S112, the controller 30 controls the proportional valve 31, and automatically moves at least one of the attachment or the machine body (the lower traveling body 1 and the upper turning body 3) on the basis of a driving instruction of the computation device 30E, so that the attaching portion at the end of the arm 5 is aligned with the corresponding counter-attaching portion of the replacement end attachment. For example, in a case where the end of the arm 5 cannot reach or does not face the replacement end attachment when the end attachment 6 is detached (when step S110 is completed), then, in this step, the shovel 100 performs the directly-facing movement. Then, in a state in which the end of the arm 5 can reach or faces the replacement end attachment, the shovel 100 performs a final aligning movement so that the attaching portion at the end of the arm 5 matches with the counter-attaching portion of the end attachment 6 (hereinafter referred to as a "final aligning movement"). Also, for example, in a case where the end of the arm 5 can reach and faces the replacement end attachment when the end attachment is detached, only the final aligning movement is performed.

Specifically, the controller 30 performs the final aligning movement in such a manner as to automatically move at least one of the attachment or the machine body so that the position of the non-movable attaching portion 12*d*1 among the attaching portions 12*d*1, 12*d*2 of the detachable apparatus 12 is aligned with the position of the corresponding counter-attaching portion of the replacement end attachment. In this case, the computation device 30E may sequentially recognize the position of the attaching portion 12*d* of the detachable apparatus 12 and the position of the counter-attaching portion of the end attachment under the control of the controller 30, on the basis of images captured by the image-capturing apparatus 40. Instead of or in addition to the computation result of the computation device 30E, the controller 30 may recognize (identify) the position of the counter-attaching portion of the end attachment on the basis of information about replacement end attachments registered in the database of end attachments established in advance.

For example, as indicated in the task states 320, 330 of FIG. 3B, in this example, as described above, the shovel 100 is in such a state that the attaching portion at the end of the arm 5 (the attaching portion 12*d* of the detachable apparatus 12) directly faces the counter-attaching portion of the bucket 6B (specifically, a state in which the axis of the attaching portion 12*d* at the end of the arm 5 is substantially parallel with the axis of the counter-attaching portion of the bucket 6B (for example, an attachment pin)). Therefore, the shovel 100 moves closer to the position of the bucket 6B by automatically moving the attachment and moving the end of the arm 5 to the rear side from the position where the bucket 6A is detached under the control of the controller 30 and the computation device 30E. Specifically, the shovel 100 may automatically perform the raising movement of the boom 4 and the closing movement of the arm 5 under the control of the controller 30 and the computation device 30E. Then, the shovel 100 may automatically move the attachment and align the attaching portion 12*d*1 of the detachable apparatus 12 of the end of the arm 5 with the corresponding counter-attaching portion of the bucket 6B under the control of the controller 30 and the computation device 30E. In the task states 320, 330 of FIG. 3B, instead of or in addition to the attachment, the shovel 100 may cause the lower traveling body 1 to automatically travel to align the attaching portion 12*d*1 of the detachable apparatus 12 of the end of the arm 5 with the corresponding counter-attaching portion of the bucket 6B in such a manner as to move the end of the arm 5 to the rear side toward the position of the bucket 6B from the position where the bucket 6A is detached. For example, when the bucket 6A is detached (when step S110 is completed), the height (the vertical position) of the end of the arm 5 is positioned at the height of the counter-attaching portion of the attaching-target bucket 6B. In such case, the aligning can be performed by only causing the lower traveling body 1 to travel to the rear side.

Also, for example, as illustrated in FIG. 3C, in a case where the bucket 6A is detached and placed to the storage space 520, the shovel 100 does not face the replacement bucket 6B of the storage space 510 (see the shovel 100 indicated by broken lines in the drawing). Therefore, as described above, the shovel 100 returns back to the state of facing the replacement bucket 6B by moving the end of the arm 5 from the storage space 520 to the storage space 510 by automatically turning the upper turning body 3 under the control of the controller 30 and the computation device 30E. In other words, the shovel 100 automatically turns the upper turning body 3 so that the attaching portion 12*d* of the end of the arm 5 (the detachable apparatus 12) faces the counter-attaching portion of the replacement bucket 6B. Then, similarly to the case of FIG. 3B, the shovel 100 automatically moves at least one of the attachment or the lower traveling body 1, so that the attaching portion 12*d*1 of the detachable apparatus 12 of the end of the arm 5 can be aligned with the corresponding counter-attaching portion of the bucket 6B.

Returning to FIG. 3A, when the processing of step S112 is finished, the controller 30 proceeds to step S114.

In step S114, on the basis of the driving instruction generated by the computation device 30E, the controller 30 controls the proportional valve 31 to attach the replacement end attachment to the end of the arm 5. Specifically, the controller 30 controls the proportional valve 31 to move the hydraulic cylinder 12*c* in an extending direction, so that the counter-attaching portion of the replacement end attachment is attached to the attaching portion 12*d* of the detachable apparatus 12. Accordingly, the shovel 100 can automatically perform a movement for attaching the replacement end attachment to the end of the arm 5 (hereinafter referred to as an "attaching movement").

For example, as indicated in the task state 340 of FIG. 3B, the shovel 100 attaches the bucket 6B to the end of the arm 5 (the attaching portion 12*d* of the detachable apparatus 12) under the control of the controller 30 and the computation device 30E. Accordingly, instead of the bucket 6A, the shovel 100 can start a task using the bucket 6B to which the bucket 6A has been changed.

Returning to FIG. 3A, when the processing of step S114 is completed, the controller 30 ends the current processing of this flowchart.

In this manner, without relying on the operator's operation, the shovel 100 automatically moves all the necessary driven elements, so that the change task of the shovel 100 for changing the end attachment 6 with the full-automatic driving function can be performed. Specifically, without relying on the operator's operation, the shovel 100 automatically performs the detaching movement, the directly-facing movement, the final aligning movement, and the attaching movement, so that the change task for changing the end attachment 6 with the full-automatic driving function can be performed.

In the change task for changing the end attachment 6, at least one of the detaching movement, the directly-facing movement, or the attaching movement may be manually executed by the operator's operation.

Also, for example, under the control of the controller 30 and the computation device 30E, the shovel 100 may perform the change task for changing the end attachment 6 with the semi-automatic driving function in such a manner as to assist (support) the operator's operation according to the operator's operation.

Specifically, the shovel 100 may perform the change task for changing the end attachment with the semi-automatic driving function according to the operator's operation while automatically moving the driven elements other than the operator's operation target.

For example, the shovel 100 may perform the directly-facing movement by automatically turning the upper turning body 3 in addition to causing the lower traveling body 1 to travel according to the operator's operation (hereinafter referred to as a "traveling operation") for operating the lower traveling body 1 (the left and right crawlers 1C). Specifically, under the control of the controller 30 and the computation device 30E, the shovel 100 sequentially recognizes the relative position of the replacement end attachment from the image information captured by the image-capturing apparatus 40. Also, the shovel 100 generates the target locus of the end of the arm 5 on the basis of the recognized relative position of the replacement end attachment, the operator's operation content, and the like. Then, the shovel 100 achieves the directly-facing movement of the semi-automatic driving function in such a manner as to automatically move the lower traveling body 1 and the upper turning body 3, so that the end of the arm 5 moves along the target locus, according to the operator's traveling operation.

For example, the shovel 100 may perform the final aligning movement by automatically moving the boom 4 in addition to moving the arm 5 according to the operator' operation of the arm 5 (hereinafter referred to as an "arm operation"). Specifically, the shovel 100 sequentially recognizes the relative position of the replacement end attachment from the image information captured by the image-capturing apparatus 40 under the control of the controller 30 and the computation device 30E. The shovel 100 generates the target locus of the end of the arm 5 on the basis of the recognized relative position of the replacement end attachment, the operator's operation content, and the like. Then, the shovel 100 may achieve the final aligning movement with the semi-automatic driving function in such a manner as to automatically move the arm 5 and the boom 4, so that the end of the arm 5 moves along the target locus, according to the operator's arm operation.

The shovel 100 may perform the change task for changing the end attachment with the semi-automatic driving function while automatically adjusting, according to the operator's operation, the movement of the driven element that is operated by the operator's operation. The adjustment of the movement of the driven element that is operated by the operator's operation means that, while the actual operation direction of the movement of the driven element that is operated by the operator's operation is set to the same operation direction as the operation content, the actual operation quantity is adjusted from the operation quantity corresponding to the operation content. In this case, the controller 30 controls the proportional valve 31 corresponding to the movement of the driven element that is operated by the operator's operation, so that the pilot pressure that is adjusted to be smaller or larger than the actual operation quantity is applied to the control valve unit 17. Accordingly, for example, even in a situation where the shovel 100 would fail to face the replacement end attachment or go past the replacement end attachment if the operator's operation content were adopted, the shovel 100 can be caused to appropriately face the replacement end attachment. For example, even in a situation where the attaching portion at the end of the arm 5 would fail to reach or go past the counter-attaching portion of the replacement end attachment if the operator's operation content were adopted, the attaching portion at the end of the arm 5 and the counter-attaching portion of the replacement end attachment can be aligned appropriately.

In a case where the operating apparatus 26 is of a hydraulic pilot type (see FIG. 2A), a decompression valve is preferably provided between the operating apparatus 26 and the shuttle valve 32, so that the pilot pressure corresponding to the operation by the operator of the cab 10 is not applied to the inlet port of the shuttle valve 32. Then, in a case where the movement of the driven element that is operated by the operator's operation is automatically adjusted, the pilot pressure corresponding to the operation content is not applied to the shuttle valve 32 by activating the decompression valve in the pilot line on the secondary side of the operating apparatus 26 corresponding to the driven element to be operated. This is because a pilot pressure smaller than the pilot pressure that is output from the operating apparatus 26 may be desired to be applied from the proportional valve 31 via the shuttle valve 32 to the control valve unit 17.

For example, the shovel 100 may perform the directly-facing movement of the semi-automatic driving function by automatically adjusting the operation quantity of the lower traveling body 1 and the operation quantity of the upper turning body 3 according to the operator's operation of the lower traveling body 1 and the upper turning body 3.

For example, the shovel 100 may perform the final aligning movement with the semi-automatic driving function by automatically adjusting the operation quantity of the attachment according to the operator's operation of the attachment (at least one of the boom 4 or the arm 5).

Also, in a case where the attaching portion at the end of the arm 5 matches in height (vertical position) with the counter-attaching portion of the replacement end attachment, the shovel 100 may perform the final aligning movement with the semi-automatic driving function by automatically adjusting the operation quantity (the movement quantity) of the lower traveling body 1 according to the operator's traveling operation.

In this manner, the shovel 100 can perform the change task of the shovel 100 for changing the end attachment 6 with the semi-automatic driving function according to the operator's operation. Specifically, for example, the shovel 100 can perform the change task for changing the end attachment 6 with the semi-automatic driving function in such a manner as to support the operator's operation corresponding to the directly-facing movement and the final aligning movement.

Effects

Next, the effects of the shovel 100 according to the present embodiment are explained.

In the present embodiment, the shovel 100 aligns a link unit (the boom 4 and the arm 5), which is supported to be movable on the machine body (an example of a support unit) constituted by the lower traveling body 1, the upper turning body 3, and the like, with the end attachment. Specifically, the shovel 100 aligns the link unit with the end attachment automatically (i.e., without relying on the operator's operation) or in such a manner as to support the operator's operation. For example, the shovel 100 may align the attaching portion 12*d* at the end of the arm 5 with the counter-attaching portion of the end attachment, which is to be attached to the end of the arm 5, placed on the ground surface around the shovel in question.

Accordingly, the shovel 100 can perform at least a portion of the change task for changing the end attachment 6 in a semi-automatic and a full-automatic manner. Therefore, for example, in a case where the shovel 100 is operated by the operator, the shovel 100 can align the attaching portion 12*d* at the end of the arm 5 with the attaching-target (replacement) counter-attaching portion of the end attachment in a relatively short period of time, without relying on the operator' proficiency. In addition, for example, even in a case where the shovel 100 has an automatic driving function, the shovel 100 can reduce, as compared with the case where everything is performed manually, the period of time required for the change task for changing the end attachment 6, due to the addition of automation of the change task for changing the end attachment 6. Therefore, the efficiency in the change task for changing the end attachment 6 can be improved.

In the present embodiment, the shovel 100 may align the link unit with the end attachment, so that the attaching portion of the link unit matches with the position of the counter-attaching portion of the end attachment.

Accordingly, of the change task for changing the end attachment 6, the shovel 100 can perform the final aligning movement in a semi-automatic and a full-automatic manner.

In the present embodiment, the image-capturing apparatus 40 (an example of a first obtaining unit and a second obtaining unit) may obtain information about the position of each of the attaching portion of the link unit and the counter-attaching portion of the end attachment. Then, the shovel 100 may move the attaching portion of the link unit to match with the position of the counter-attaching portion of the end attachment, on the basis of the information about the position of each of the attaching portion of the link unit and the counter-attaching portion of the end attachment, obtained by the image-capturing apparatus 40.

Accordingly, the shovel 100 can more specifically perform the final aligning movement in a semi-automatic and a full-automatic manner.

In addition, in the present embodiment, the shovel 100 may move at least one of the attachment or the machine body (the lower traveling body 1 and the upper turning body 3) in an automatic manner or in such a manner as to support the operator's operation, so that (the attaching portion 12*d* of) the end of the arm 5 is aligned with (the counter-attaching portion of) of the end attachment.

Accordingly, the shovel 100 can more specifically align the attaching portion 12*d* at the end of the arm 5 with the counter-attaching portion of the attaching-target (replacement) end attachment.

In addition, in the present embodiment, the shovel 100 may move only the link unit, among the link unit and the machine body, in an automatic manner or in such a manner as to support the operator's operation, so that the link unit is aligned with the end attachment.

Accordingly, for example, the shovel 100 can perform the final aligning movement in a semi-automatic or full-automatic manner, with only the movement of the link unit, starting from the state in which the end of the link unit can reach and faces the replacement end attachment.

In addition, in the present embodiment, the shovel 100 may cause the machine body to perform at least one of the traveling movement or the turning movement in an automatic manner or in such a manner as to support the operator's operation, so that the link unit faces the end attachment.

Accordingly, in the change task for changing the end attachment 6, the shovel 100 can perform the directly-facing movement in a semi-automatic and a full-automatic manner.

In addition, in the present embodiment, the shovel 100 may move the attachment in an automatic manner or in such a manner as to support the operator's operation, so that the attaching portion 12*d* at the end of the arm 5 matches with the position of the counter-attaching portion of the end attachment in such a state that the attaching portion 12*d* at the end of the arm 5 directly faces the counter-attaching portion of the end attachment.

Accordingly, the shovel 100 moves the link unit (the boom 4 and the arm 5 of the attachment) in a semi-automatic or a full-automatic manner, so that the positioning (the final aligning movement) between the attaching portion 12*d* at the end of the arm 5 and the counter-attaching portion of the end attachment can be performed specifically.

In addition, in the present embodiment, the shovel 100 may turn the upper turning body 3 in an automatic manner or in such a manner as to support the operator's operation, so that the attaching portion 12*d* at the end of the arm 5 faces the counter-attaching portion of the end attachment.

Accordingly, the shovel 100 turns the upper turning body 3 in a semi-automatic or a full-automatic manner, so that the positioning between the attaching portion 12*d* at the end of the arm 5 and the counter-attaching portion of the end attachment can be performed specifically.

In addition, in the present embodiment, the shovel 100 may cause the lower traveling body 1 to travel in an automatic manner or in such a manner as to support the operator's operation, so that the shovel in question moves to a position where the attaching portion at the end of the arm 5 can reach the counter-attaching portion of the end attachment. In addition, in the present embodiment, the shovel 100 may cause the lower traveling body 1 to travel in an automatic manner or in such a manner as to support the operator's operation, so that the attaching portion 12*d* at the end of the arm 5 matches with the position of the counter-attaching portion of the end attachment in such a state that the attaching portion 12*d* at the end of the arm 5 directly faces the counter-attaching portion of the end attachment.

Accordingly, the shovel 100 causes the lower traveling body 1 to travel in a semi-automatic and a full-automatic manner, so that the positioning (the directly-facing movement and the final aligning movement) between the attaching portion 12*d* at the end of the arm 5 and the counter-attaching portion of the end attachment can be performed specifically.

In addition, in the present embodiment, the shovel 100 may include a sensor (image-capturing apparatus 40) configured to detect an end attachment around the shovel in question.

Accordingly, the shovel 100 can automatically recognize a presence of a replacement end attachment placed on the ground surface around the shovel in question, a relative position thereof, and the like, on the basis of output information (captured image) of the image-capturing apparatus 40.

In addition, in the present embodiment, the attaching portion 12*d* at the end of the link unit (the arm 5) may be provided with the movable unit 12*b* for switching between a fixed state and an unfixed state between the arm 5 and the end attachment 6 and a hydraulic cylinder 12*c* (an example of an actuator) for driving the movable unit 12*b*. Also, the shovel 100 may align the attaching portion 12*d* at the end of the arm 5 with the counter-attaching portion of the end attachment in such a state that the movable unit 12*b* and the hydraulic cylinder 12*c* are in a state corresponding to the unfixed state and move the hydraulic cylinder 12*c* in an automatic manner or in such a manner as to support the operator's operation, so that the counter-attaching portion of the end attachment is fixed to the attaching portion 12*d* at the end of the arm 5.

Accordingly, the shovel 100 can perform not only the aligning between the attaching portion at the end of the arm 5 and the counter-attaching portion of the end attachment but also a movement for attaching (fixing) the end attachment (attaching movement) in a semi-automatic and a full-automatic manner.

As described above, the detaching movement of the end attachment 6 (step S110 of FIG. 3A) and the attaching movement of the end attachment (step S114 of FIG. 3A) may be performed manually. In this case, the detachable apparatus 12 may be omitted.

According to the above embodiment, a shovel and the like capable of improving the efficiency of a change task for changing an end attachment can be provided.

MODIFICATIONS AND CHANGES

Although the embodiment has been hereinabove described in detail, the present disclosure is not limited to such a specific embodiment, and various modifications and changes can be made within the subject matter described in the claims.

For example, although, in the above embodiment, the shovel 100 is configured to hydraulically drive all of various operation elements such as the lower traveling body 1, the upper turning body 3, the boom 4, the arm 5, the end attachment 6, the detachable apparatus 12, and the like, some of them may be configured to be electrically driven. In other words, the configuration and the like disclosed in the above embodiment may be applied to a hybrid shovel, an electric shovel, and the like.

In the above embodiment and modifications, the operating apparatus 26 may be omitted. Specifically, in the above embodiment and modifications, the shovel 100 does not have to receive the operator's operation and may be fully automated.

What is claimed is:

1. A shovel comprising:

a lower traveling body;

an upper turning body turnably mounted on the lower traveling body;

a link unit attached to the upper turning body;

a camera or a sensor attached to the upper turning body; and a processing circuitry configured to identify a position of an end attachment to be attached to an end of the link unit based on an image captured by the camera or the sensor, the end attachment being detached from the link unit, determine, based on the identified position of the end attachment to be attached, one or more movements of the shovel for aligning an attaching portion at the end of the link unit with a counter-attaching portion of the end attachment to be attached, from among a traveling movement of the lower traveling body, a turning movement of the upper turning body, and a movement of the link unit, and cause the shovel to perform the determined one or more movements, automatically or in such a manner as to support an operator's operation, to align the attaching portion with the counter-attaching portion.

2. The shovel according to claim 1, wherein the processing circuitry is configured to perform at least one of the traveling movement of the lower traveling body or the turning movement of the upper turning body to cause the link unit to directly face the end attachment as the one or more movements of the shovel.

3. The shovel according to claim 1, wherein the processing circuitry is configured to cause the shovel to perform the traveling movement of the lower traveling body as the one or more movements of the shovel, so that the shovel moves to a position where the attaching portion reaches the counter-attaching portion, or the attaching portion matches with a position of the counter-attaching portion in such a state that the attaching portion directly faces the counter-attaching portion.

4. The shovel according to claim 1, wherein the attaching portion includes:

a movable unit configured to switch a fixed state and an unfixed state of the link unit and the end attachment; and a hydraulic or electric actuator configured to drive the movable unit, wherein the processing circuitry is configured to align the attaching portion with the counter-attaching portion while the movable unit and the hydraulic or electric actuator are in a state corresponding to the unfixed state, and the processing circuitry is configured to move the hydraulic or electric actuator, so that the counter-attaching portion is fixed to the attaching portion.

5. The shovel according to claim 1, further comprising:

a display configured to display information about candidates for the end attachment obtained based on the image captured by the camera or the sensor, the candidates being around the shovel;

an input unit configured to receive a predetermined input from a user; and a selecting unit configured to select the end attachment from among the candidates in response to the predetermined input received by the input unit.

* * * * *